US010493768B2

(12) United States Patent
Hayashi et al.

(10) Patent No.: US 10,493,768 B2
(45) **Date of Patent: *Dec. 3, 2019**

(54) TANK AND LIQUID CONSUMING APPARATUS INCLUDING THE SAME

(71) Applicant: BROTHER KOGYO KABUSHIKI KAISHA, Nagoya-shi, Aichi-ken (JP)

(72) Inventors: Masahiro Hayashi, Nagoya (JP); Taichi Shirono, Nagoya (JP); Masako Kawagoe, Nagoya (JP); Yoshinori Osakabe, Seto (JP); Masataka Kamiya, Owariasahi (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/185,150

(22) Filed: Nov. 9, 2018

(65) Prior Publication Data

US 2019/0077161 A1 Mar. 14, 2019

Related U.S. Application Data

(63) Continuation of application No. 15/473,859, filed on Mar. 30, 2017, now Pat. No. 10,124,594.

(30) Foreign Application Priority Data

Mar. 31, 2016 (JP) ..... 2016-073640

(51) Int. Cl.
*B41J 2/17* (2006.01)
*B41J 2/175* (2006.01)
(Continued)

(52) U.S. Cl.
CPC ..... *B41J 2/17523* (2013.01); *B41J 2/17509* (2013.01); *B41J 2/17513* (2013.01);
(Continued)

(58) Field of Classification Search
None
See application file for complete search history.

(56) References Cited

U.S. PATENT DOCUMENTS

2008/0252701 A1 10/2008 Matsumoto
2011/0069126 A1* 3/2011 Feng ..... B41J 2/17513 347/87

(Continued)

FOREIGN PATENT DOCUMENTS

CN 1217801 C 9/2005
JP 2012-51306 A 3/2012
JP 2014-46531 A 3/2014

OTHER PUBLICATIONS

Chinese Office Action issued in related Chinese application No. 201710187484.9, dated Aug. 27, 2019.

*Primary Examiner* — Erica S Lin
(74) *Attorney, Agent, or Firm* — Merchant & Gould P.C.

(57) ABSTRACT

A tank is configured to be installed in a liquid consuming apparatus having a liquid consuming unit. The tank includes: a casing having a first partition wall defining a first storage chamber configured to store liquid and a second partition wall defining a second storage chamber configured to store the liquid. The casing is formed with: an inlet provided to inject the liquid into the first storage chamber and the second storage chamber; a communication port communicating the first storage chamber and the second storage chamber; an atmosphere opening port communicating the second storage chamber and the outside of the tank; and a liquid outflow port through which the liquid stored in the first storage chamber and the second storage chamber flows out toward the liquid consuming unit.

2 Claims, 12 Drawing Sheets

(51) Int. Cl.
*B41J 29/02* (2006.01)
*B41J 29/13* (2006.01)

(52) U.S. Cl.
CPC ..... *B41J 2/17553* (2013.01); *B41J 2/17566* (2013.01); *B41J 29/02* (2013.01); *B41J 29/13* (2013.01); *B41J 2002/17573* (2013.01)

(56) References Cited

U.S. PATENT DOCUMENTS

| | | | |
|---|---|---|---|
| 2012/0056938 | A1 | 3/2012 | Ishizawa et al. |
| 2014/0063139 | A1 | 3/2014 | Iwamuro et al. |

* cited by examiner

TANK AND LIQUID CONSUMING APPARATUS INCLUDING THE SAME

CROSS REFERENCE TO RELATED APPLICATION

The present application is a continuation of U.S. patent application Ser. No. 15/473,859, filed Mar. 30, 2017, which further claims priority from Japanese Patent Application No. 2016-073640 filed on Mar. 31, 2016, the disclosures of both of which are incorporated herein by reference in their entirety.

BACKGROUND

Field of the Invention

The present invention relates to a tank capable of being refilled with liquid via an inlet and a liquid consuming apparatus including the tank.

Description of the Related Art

There is known a printer that includes: a tank capable of being refilled with ink; and a recording head to record an image on a sheet by jetting, from a nozzle, the ink supplied from the tank. If the ink in the tank is consumed, then it is possible for a user to refill the tank with the ink retained in a bottle from an inlet of the tank.

The tank is provided with an atmosphere opening port for maintaining the internal pressure of the tank at atmospheric pressure. Ordinarily, the atmosphere opening port is provided in an upper portion of the tank in a usable posture.

Further, there is known a tank whose inner part is partitioned into a plurality of spaces. With respect to such a tank, even if the tank is put in an inverted state or an inclined state due to transportation, packaging or the like, communication ports and/or communication passages connected to the atmosphere opening port may still be positioned above parts of the plurality of spaces. In such cases, the ink retained in those parts of the spaces will not leak out of the atmosphere opening port. That is, even if the tank is put in an inverted state or an inclined state due to transportation, packaging or the like, it is still possible to confine the ink leaking out of the atmosphere opening port only to the ink in some of the plurality of spaces.

SUMMARY

However, if the tank is configured to partition its inner part into a plurality of spaces, then such problems as stated below are liable to arise. That is, because the tank has a complicated internal construction, the ink in the tank is liable to uncomplete consumption such that some of the ink may remain in the tank. Further, because the tank has a complicated internal construction, air bubbles in the tank are liable to reach to the supply port of the tank connected with the recording head through a tube. Because of this, those air bubbles are liable to be supplied to the recording head through the supply port so as to negatively affect images recorded on paper.

The present teaching is made in view of the above situation, and an object thereof is to provide a tank capable of reducing the amount of remaining liquid and reducing the outflow of air bubbles even if the inner part of the tank is partitioned into a plurality of spaces.

According to an aspect of the present teaching, there is provided a tank configured to be installed in a liquid consuming apparatus having a liquid consuming unit, the tank including: a casing having a first partition wall defining a first storage chamber configured to store liquid and a second partition wall defining a second storage chamber configured to store the liquid, wherein the casing is formed with: an inlet provided to inject the liquid into the first storage chamber and the second storage chamber; a communication port communicating the first storage chamber and the second storage chamber; an atmosphere opening port communicating the second storage chamber and the outside of the tank; and a liquid outflow port through which the liquid stored in the first storage chamber and the second storage chamber flows out toward the liquid consuming unit, and with the tank in a usable posture, the second storage chamber includes a lower storage chamber formed below the first storage chamber, and an upper storage chamber extending upward from the lower storage chamber and being in communication with the atmosphere opening port, the first partition wall has a first surface forming a lower surface of the first storage chamber, the second partition wall has a second surface forming an upper surface of the lower storage chamber, the communication port is formed in the first surface and the second surface, the liquid outflow port is formed in a lower portion of the lower storage chamber, the first surface is inclined such that the communication port is positioned at the lowermost end, and the second surface is inclined such that the communication port is positioned at the lowermost end and a boundary position between the lower storage chamber and the upper storage chamber is at the uppermost end.

According to the above configuration, the first surface is inclined such that the communication port is positioned at the lowermost end. Therefore, it is possible to cause the total amount of the liquid stored in the first storage chamber to flow into the second storage chamber through the communication port. As a result, it is possible to reduce the amount of the liquid remaining in the tank.

Further, according to the above configuration, the second surface is inclined such that the communication port is positioned at the lowermost end and the boundary position between the lower storage chamber and the upper storage chamber is at the uppermost end. By virtue of this, even if some air bubbles could enter the second storage chamber through the communication port, those air bubbles move along the second surface into the upper storage chamber. As a result, it is possible to reduce the possibility for the air bubbles to reach to the liquid outflow port provided in the lower portion of the lower storage chamber.

DESCRIPTION OF THE EMBODIMENT

Figure 1A:
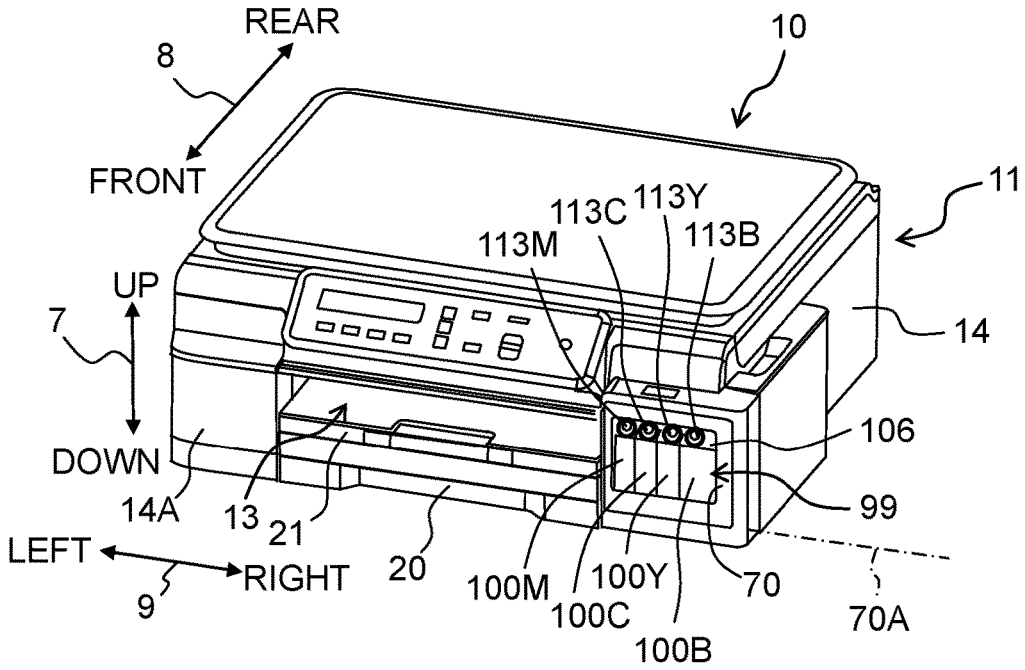
FIG. 1A is a perspective view of external appearance of a multifunction peripheral in a state where a cover is in a closed position.

An embodiment of the present teaching will be explained below. Further, it is needless to say that the embodiment explained below is merely one example of the present teaching and thus it is possible to appropriately change the embodiment of the present teaching without changing the gist or essential characteristics of the present teaching. Such a posture of a multifunction peripheral 10 and an ink tank 100 installed in the multifunction peripheral 10 as usably arranged on a horizontal plane is referred to as "usage posture" (the posture depicted in FIGS. 1A and 1B). An up-down direction 7 is defined with reference to the usage posture. A front-rear direction 8 is defined with an opening 13 provided in the front side of the multifunction peripheral 10. A left-right direction 9 is defined with the multifunction peripheral 10 being viewed from the front. In this embodiment, in the usage posture, the up-down direction 7 corresponds to the vertical direction, while the front-rear direction 8 and the left-right direction 9 correspond to the horizontal direction. Further, the upward direction is one component of the up-down direction 7 while the downward direction is also one component of the up-down direction 7. Likewise, each of the leftward direction and the rightward direction is one component of the left-right direction 9. Each of the frontward direction and the rearward direction is one component of the front-rear direction 8.

<Overall Structure of Multifunction Peripheral 10>

Figure 1B:
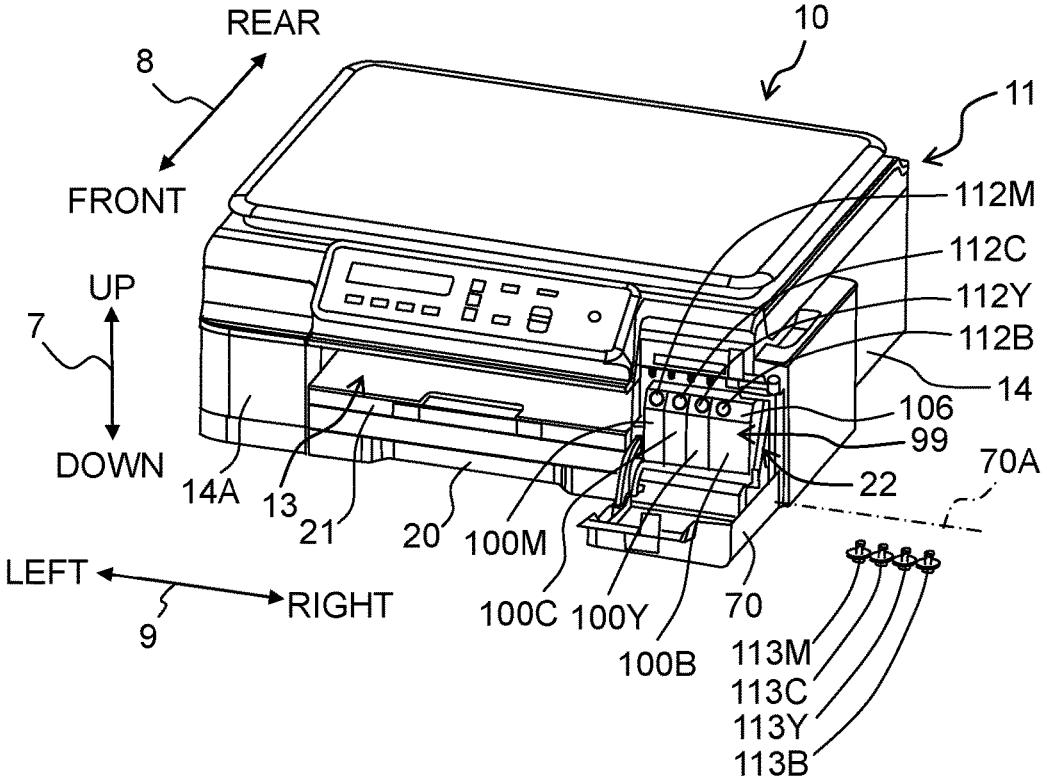
FIG. 1B is a perspective view of external appearance of the multifunction peripheral in a state where the cover is in an opened position.
Figure 2:
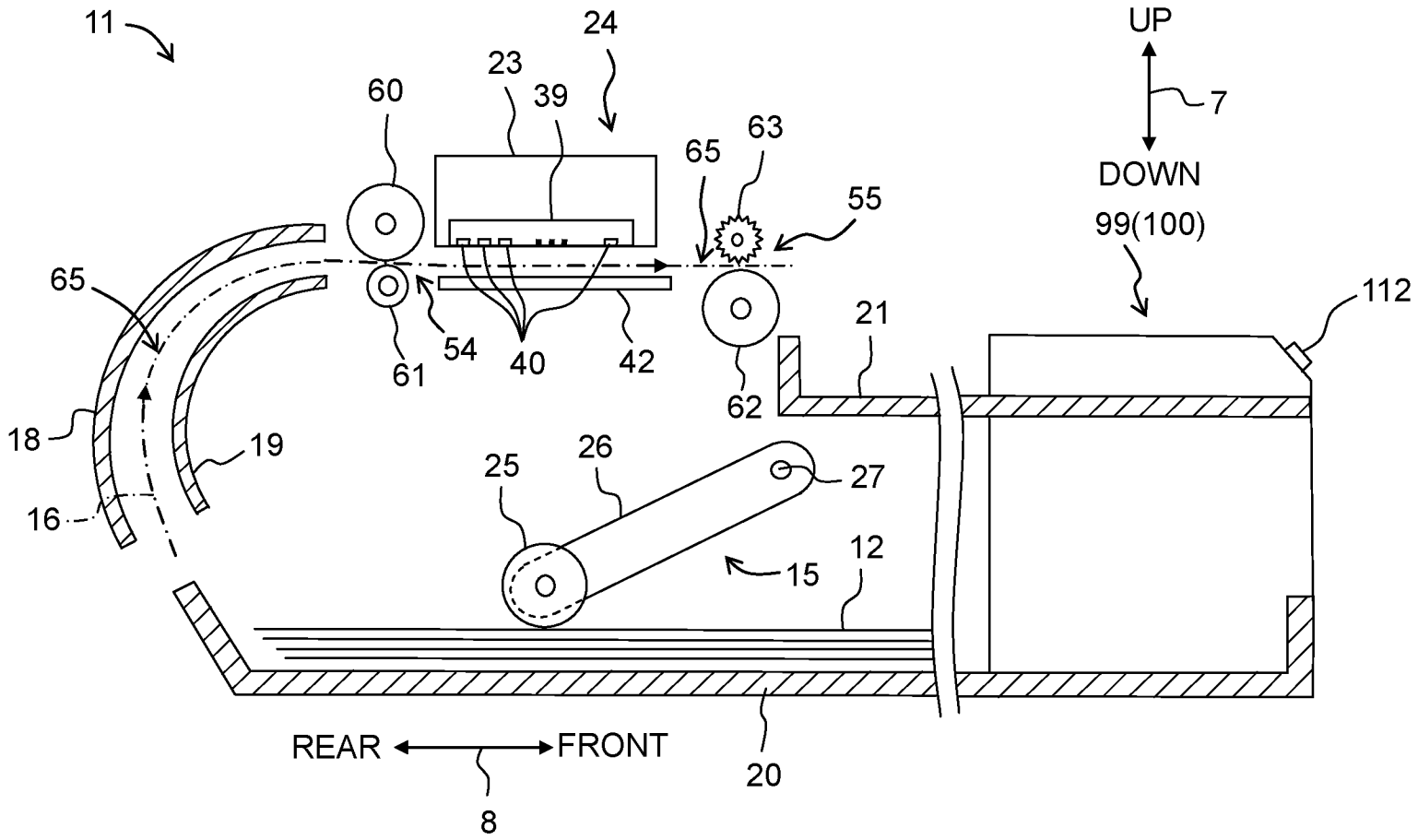
FIG. 2 is a longitudinal cross-sectional view schematically depicting an internal structure of a printer unit of the multifunction peripheral.

As depicted in FIGS. 1A and 1B, the multifunction peripheral 10 (an example of the liquid consuming apparatus) has an approximate cuboid shape. The multifunction peripheral 10 is provided with a printer unit 11 in its lower portion to record image on paper 12 (see FIG. 2) by an ink jet recording method. The printer unit 11 has a casing 14. The opening 13 formed in a front wall 14A of the casing 14. As depicted in FIG. 2, inside the casing 14, there are arranged a feed unit 15, a feed tray 20, a discharge tray 21, a conveyance roller unit 54, a recording unit 24, a discharge roller unit 55, a platen 42, and a tank set 99. The multifunction peripheral 10 has various functions such as a facsimile function, a print function, and the like.

<Feed Tray 20 and Discharge Tray 21>

The opening 13 is formed in the front side of the multifunction peripheral 10 and in a central portion along the left-right direction 9. As depicted in FIGS. 1A and 1B, the feed tray 20 can be inserted into or removed from the multifunction peripheral 10 by a user along the front-rear direction 8 via the opening 13. The feed tray 20 can support a plurality of stacked sheets of the paper 12. The discharge tray 21 is arranged above the feed tray 20 and can be inserted or removed together with the feed tray 20. The discharge tray 21 supports the paper 12 discharged by the discharge roller unit 55 from between the recording unit 24 and the platen 42.

<Feed Unit 15>

The feed unit 15 feeds the paper 12 supported by the feed tray 20 to a conveyance passage 65. As depicted in FIG. 2, the feed unit 15 includes a feeding roller 25, a feeding arm 26, and a shaft 27. The feeding roller 25 is rotatably supported in a leading end portion of the feeding arm 26. The feeding roller 25 is caused to rotate in the orientation of conveying the paper 12 in a conveyance orientation 16 by the reverse rotation of a conveyance motor (not depicted). Hereinbelow, the term "forward rotation" refers to the rotations of the feeding roller 25, a conveyance roller 60 and a discharge roller 62 in the orientation of conveying the paper 12 in the conveyance orientation 16. The feeding arm 26 is revolvably supported on the shaft 27 supported by the frame of the printer unit 11. The feeding arm 26 is biased to revolve toward the feed tray 20 by an elastic force of its own weight, a spring, or the like.

<Conveyance Passage 65>

Figure 3:
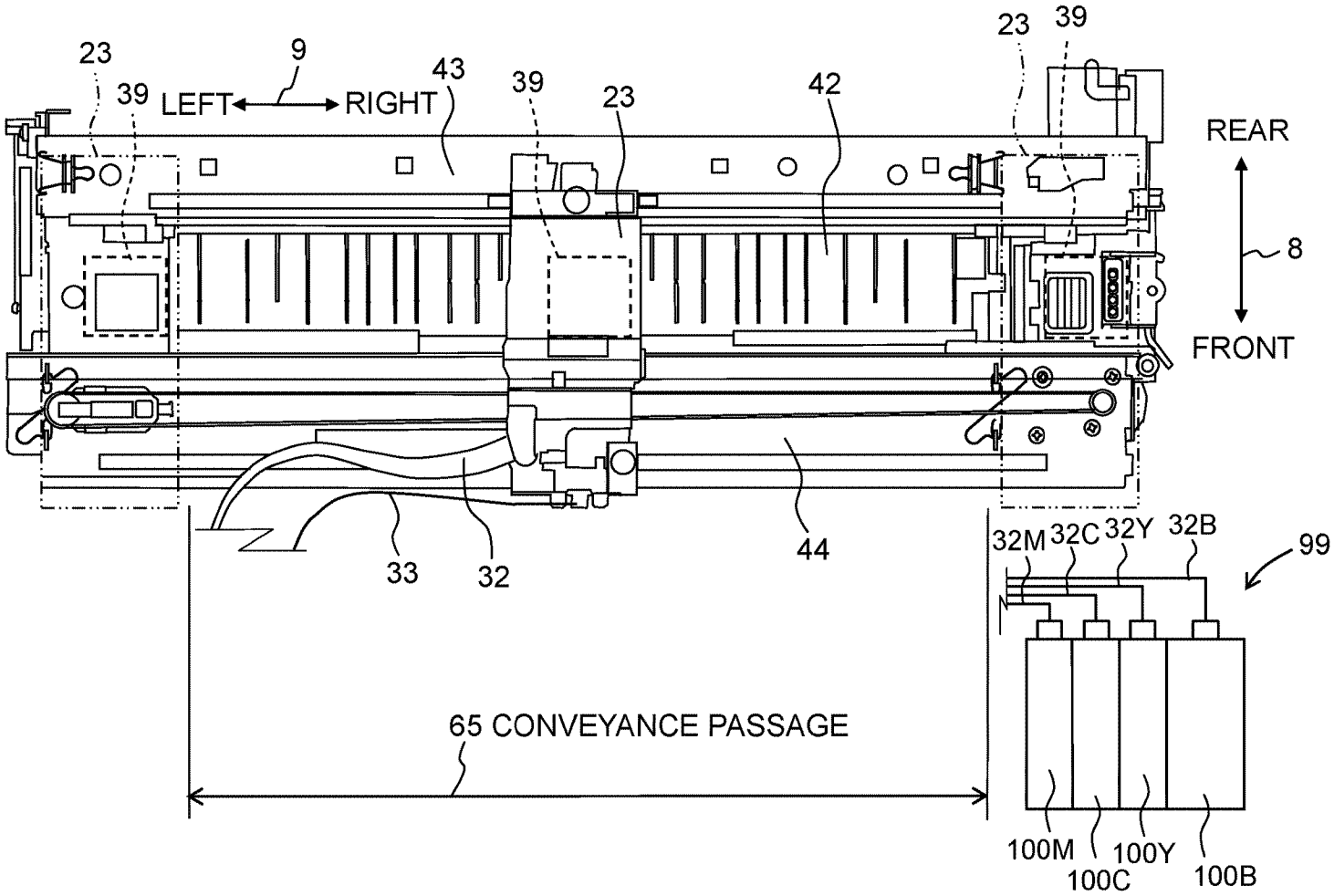
FIG. 3 is a plan view depicting an arrangement of a carriage and a tank set.

As depicted in FIG. 2, the conveyance passage 65 extends to a rear portion of the printer unit 11 from the rear end of the feed tray 20 and, while extending upward in the rear portion of the printer unit 11, U-turns frontward to pass through the space between the recording unit 24 and the platen 42 to finally reach the discharge tray 21. Part of the conveyance passage 65 is such a space formed inside the printer unit 11 by an outer guide member 18 and an inner guide member 19 facing each other at a predetermined interval. As depicted in FIGS. 2 and 3, such a part of the conveyance passage 65 as between the conveyance roller unit 54 and the discharge roller unit 55 is provided in an approximately central portion of the multifunction peripheral 10 along the left-right direction 9, and extends in the front-rear direction 8. The conveyance orientation 16 of the paper 12 in the conveyance passage 65 is depicted in FIG. 2 with an arrow along the chain line.

<Conveyance Roller Unit 54>

As depicted in FIG. 2, the conveyance roller unit 54 is arranged on the upstream side from the recording unit 24 in the conveyance orientation 16. The conveyance roller unit 54 has the conveyance roller 60 and a pinch roller 61 facing each other. The conveyance roller 60 is driven by a conveyance motor. The pinch roller 61 is caused to rotate along with the rotation of the conveyance roller 60. The paper 12 is nipped by the conveyance roller 60 in the forward rotation and the pinch roller 61 due to the positive rotation of the conveyance motor, and is conveyed in the conveyance orientation 16.

<Discharge Roller Unit 55>

As depicted in FIG. 2, the discharge roller unit 55 is arranged on the downstream side from the recording unit 24 in the conveyance orientation 16. The discharge roller unit 55 has the discharge roller 62 and a spur 63 facing each other. The discharge roller 62 is driven by the conveyance motor. The spur 63 is caused to rotate along with the rotation of the discharge roller 62. The paper 12 is nipped by the discharge roller 62 in the forward rotation and the spur 63 due to the positive rotation of the conveyance motor, and is conveyed in the conveyance orientation 16.

<Recording Unit 24>

As depicted in FIG. 2, the recording unit 24 is arranged between the conveyance roller unit 54 and the discharge roller unit 55 along the conveyance orientation 16. The recording unit 24 is arranged to face the platen 42 across the conveyance passage 65 along the up-down direction 7. The recording unit 24 includes a carriage 23 and a recording head 39 (an example of the liquid consuming unit).

As depicted in FIG. 3, the carriage 23 is supported by guide rails 43 and 44 provided apart in the front-rear direction 8 to extend in the left-right direction 9. The guide rails 43 and 44 are supported by the frame of the printer unit 11. The carriage 23 is connected to a publicly known belt mechanism provided on the guide rail 44. The belt mechanism is driven by a carriage motor (not depicted). The carriage motor drives the carriage 23 connected to the belt mechanism to move reciprocatingly along the left-right direction 9. The moving range of the carriage 23 extends as far as to the right side and the left side of the conveyance passage 65 as depicted with the chain lines in FIG. 3.

An ink tube 32 and a flexible flat cable 33 extend out from the carriage 23.

The ink tube 32 serves to connect the tank set 99 and the recording head 39. The ink tube 32 supplies the recording head 39 with inks (an example of the liquid) retained in four ink tanks 100B, 100Y, 100C and 100M (those ink tanks may be collectively referred to as an "ink tank 100") constituting the tank set 99. The ink tank 100 is an example of the tank. In detail, four ink tubes 32B, 32Y, 32C and 32M extend out respectively from the ink tanks 100B, 100Y, 100C and 100M and are bound together and connected with the carriage 23, to let the inks of black, magenta, cyan and yellow flow therethrough. Those four ink tubes 32B, 32Y, 32C and 32M may be collectively referred to as an "ink tube 32".

The flexible flat cable 33 electrically connects the recording head 39 and a control substrate on which a controller (not depicted) is mounted. The flexible flat cable 33 transmits control signals outputted from the controller to the recording head 39.

As depicted in FIG. 2, the recording head 39 is mounted on the carriage 23. The recording head 39 has a lower surface in which a plurality of nozzles 40 are arranged. The plurality of nozzles 40 have leading ends exposed from the lower surface of the recording head 39. The surface from which the leading ends of the nozzles 40 are exposed will be referred to below as the "nozzle surface". The recording head 39 jets the inks in the form of tiny ink droplets from the nozzles 40. In the course of moving the carriage 23, the recording head 39 jets ink droplets toward the paper 12 supported by the platen 42. By virtue of this, image is recorded on the paper 12. Further, by virtue of this, the inks retained in the ink tank are consumed.

The printer unit 11 includes a maintenance mechanism (not depicted). The maintenance mechanism carries out maintenance of the recording head 39. In detail, the maintenance mechanism carries out a purge operation of sucking the inks and air in the nozzles 40, and an operation of eliminating foreign substances and the like adhering to the nozzle surface. The maintenance mechanism sends out the inks sucked from the nozzles 40 of the recording head 39 through a tube (not depicted) to a waste ink tank (not depicted). The maintenance mechanism is arranged right below the carriage 23 positioned on the right side or the left side of the conveyance passage 65.

Before the purge operation is carried out, the carriage 23 moves to a position right above the maintenance mechanism. Thereafter, a cap (not depicted) of the maintenance mechanism moves upward to cover the nozzle surface. The cap is connected to the waste ink tank via a tube. A rotary type tube pump is arranged with the tube. The tube pump is driven to vacuate the tube. By virtue of this, the inks in the recording head 39 are sucked. The sucked inks are discharged to the waste ink tank through the cap and the tube. The nozzles 40 of the recording head 39 are sealed up by capping the recording head 39. The nozzles 40 are opened when the recording head 39 is not capped.

Further, the rotary type tube pump blocks the tube at least at one place.

<Platen 42>

As depicted in FIGS. 2 and 3, the platen 42 is arranged between the conveyance roller unit 54 and the discharge roller unit 55 along the conveyance orientation 16. The platen 42 is arranged to face the recording unit 24 across the conveyance passage 65 in the up-down direction 7. The platen 42 supports from below the paper 12 conveyed by the conveyance roller unit 54.

<Tank Set 99>

The tank set 99 retains the inks to be supplied to the recording head 39. As depicted in FIGS. 1A and 1B, the tank set 99 includes the four ink tanks 100B, 100Y, 100C, and 100M. The four ink tanks 100B, 100Y, 100C, and 100M retain the inks of the different colors, respectively. In particular, the ink tank 100B retains the black ink, the ink tank 100Y retains the yellow ink, the ink tank 100C retains the cyan ink, and the ink tank 100M retains the magenta ink. However, the number of ink tanks 100 and the colors of inks are not limited to the above example.

The four ink tanks 100B, 100Y, 100C, and 100M are arranged to align in one row along the left-right direction 9. Among the four ink tanks 100B, 100Y, 100C, and 100M, the ink tank 100B is arranged on the rightmost side whereas the ink tank 100M is arranged on the leftmost side. Further, the ink tanks 100 are not limited to the above example of arrangement positions. The ink tank 100B for the black ink is larger in size, especially in the width along the left-right direction 9, than the other ink tanks 100Y, 100C and 100M for the color inks. Further, the ink tanks 100 are not limited to the above example of relationship of size. The ink tank 100B is larger in the retainable amount of the ink than the other ink tanks 100Y, 100C, and 100M. Further, the ink tanks 100 are not limited to the above example of relationship of the retainable amounts of the inks.

As depicted in FIGS. 1A and 1B, the tank set 99 is disposed inside a right front portion of the casing 14. In other words, the tank set 99 is fixed in the multifunction peripheral 10 so as not to be easily removable from the multifunction peripheral 10. Further, the expression "not to be easily removable" refers to such a fact that, for example, it is not possible for the user to easily remove the tank set 99 from the casing 14 of the multifunction peripheral 10 in an ordinary usage state, but excludes the case where a skilled repairer removes the tank set 99 from the casing 14 of the multifunction peripheral 10 for repairing the same. Therefore, it is sufficient that the user cannot easily remove the tank set 99 from the casing 14 of the multifunction peripheral 10 in the ordinary usage state.

Each ink tank 100 has a front side exposed to the outside of the multifunction peripheral 10 through an opening 22 formed in a right portion of a front wall 14A of the casing 14. The opening 22 is adjacent to the opening 13 along the left-right direction 9. The casing 14 is provided with a cover 70. The cover 70 is revolvable between a closed position to cover the opening 22 (the position depicted in FIG. 1A) and an opened position to expose the opening 22 (the position depicted in FIG. 1B). The cover 70 has a revolving shaft (not depicted) extending in the left-right direction 9 in the vicinity of the lower end along the up-down direction 7, and is supported by the casing 14 to revolve about a revolving axis 70A of the revolving shaft.

A configuration of the ink tanks 100 will be explained below in detail. Because the ink tanks 100Y, 100C, and 100M for the color inks have the same configuration, the following explanation will be made on the configuration of one of the ink tanks 100Y, 100C, and 100M, referred to as "the ink tank 100". Further, because the configuration of the ink tank 100B for the black ink resembles the configuration of the ink tanks 100Y, 100C, and 100M, the configuration will be explained about the different parts from the ink tanks 100Y, 100C, and 100M after the configuration of the ink tanks 100Y, 100C, and 100M is explained. In this case, such components of the ink tank 100B and the ink tanks 100Y, 100C, and 100M as similar in function but more or less different in shape will be each assigned with the same numeral or alphanumeral. Further, in the following explanation, the multifunction peripheral 10 and the ink tanks 100 disposed in the multifunction peripheral 10 will be in the usage posture unless otherwise stated.

<Ink Tank 100>

Figure 4:
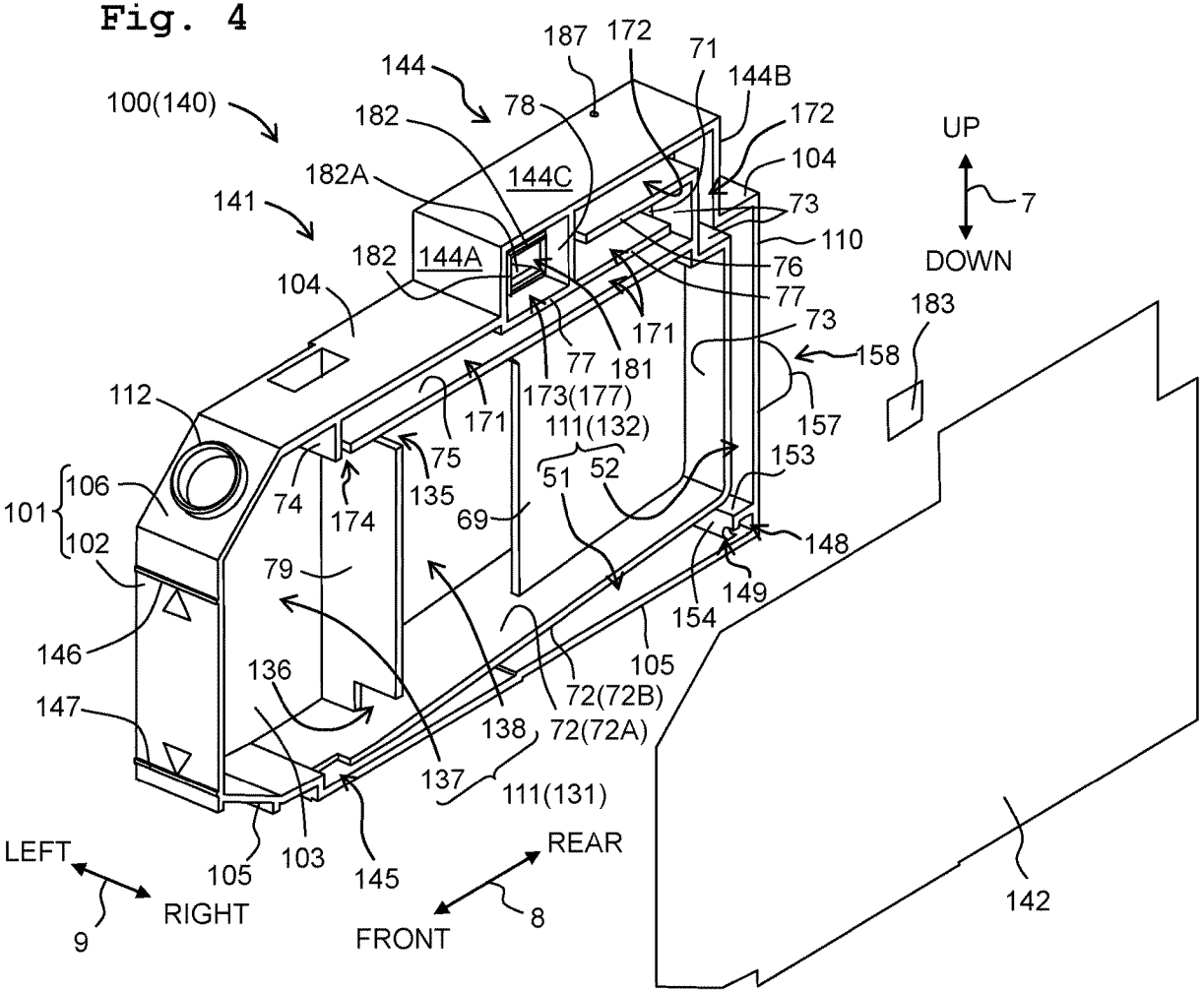
FIG. 4 is a front perspective view of an ink tank for a color ink.
Figure 5:
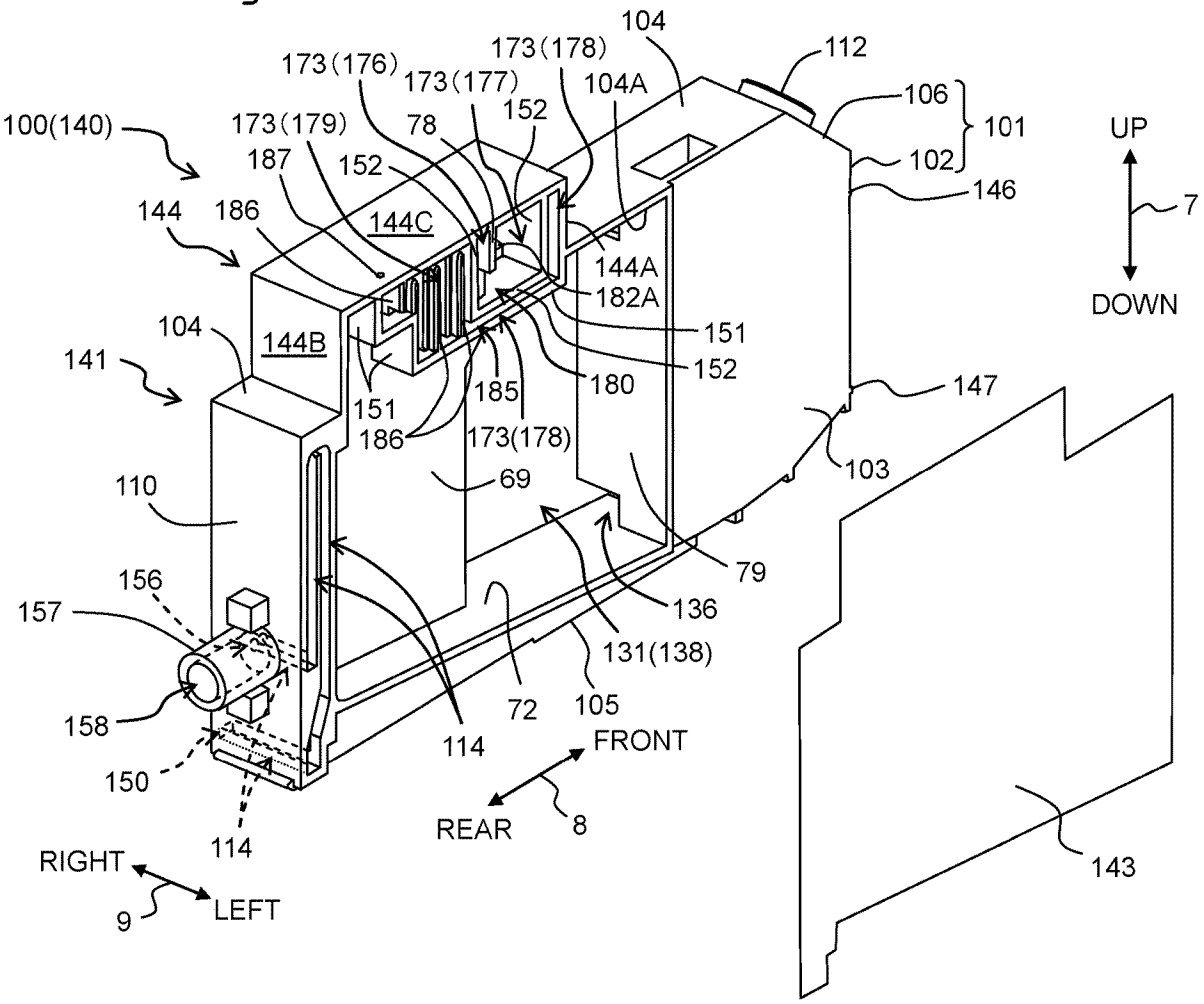
FIG. 5 is a rear perspective view of the ink tank for the color ink.

As depicted in FIGS. 4 and 5, the ink tank 100 is constructed of a casing 140 to form the external shape of the ink tank. The casing 140 includes a frame 141 and two films 142 and 143.

As a whole, the frame 141 has such a flattened cuboid shape as short in dimension along the left-right direction 9 and longer in dimension along the up-down direction 7 and the front-rear direction 8 than along the left-right direction 9. Further, the frame 141 is longer in dimension along the front-rear direction 8 than along the up-down direction 7. That is, the ink tank 100 has a first side along the front-rear direction 8, a second side along the up-down direction 7 shorter than the first side, and a third side along the left-right direction 9 shorter than the second side.

The frame 141 is formed of such a translucent resin that the ink in an aftermentioned ink chamber 111 is visible from the outside of the ink tank 100. The frame 141 is, for example, formed of polypropylene. The frame 141 is integrally molded by, for example, injection molding of a resin material. The frame 141 has a higher rigidity than the films 142 and 143.

Further, the frame 141 may be constructed of another material than resin. Further, the frame 141 may be constructed from a plurality of combined members. For example, aftermentioned first ink chamber 131 and second ink chamber 132 may be constructed respectively from two different cases being connected by a tube or the like.

The frame 141 includes a front wall 101, a left wall 103, an upper wall 104, a lower wall 105, a rear wall 110, an inner wall 69, inner walls 71 to 79, and inner walls 151 to 155.

The front wall 101 is constructed of an upstanding wall 102 and an inclined wall 106. The upstanding wall 102 extends in the up-down direction 7 and in the left-right direction 9. The inclined wall 106 serves to connect the upper end of the upstanding wall 102 and the front end of the upper wall 104, and is inclined with respect to the up-down direction 7 and to the front-rear direction 8.

The left wall 103 extends rearward from the left end of the front wall 101. The upper end of the left wall 103 is connected with a front portion of the upper wall 104. The lower end of the left wall 103 is connected with a front portion of the lower wall 105. In other words, the left wall 103 is a wall connecting the left end of the front wall 101, the front left end of the upper wall 104, and the front left end of the lower wall 105. That is, the left wall 103 is provided only in a front portion of the frame 141 but not provided in any rear portion of the frame 141.

The upper wall 104 extends rearward from the upper end of the front wall 101 (the rear end of the inclined wall 106). The front portion of the upper wall 104 is connected with the upper end of the left wall 103. A convex portion 144 is formed to project upward and extend rearward from an approximately central portion of the upper wall 104 along the front-rear direction 8. The convex portion 144 includes a front wall 144A projecting upward from the approximately central portion of the upper wall 104 along front-rear direction 8, a rear wall 144B projecting upward from a rear portion of the upper wall 104, and an upper wall 144C connecting the upper end of the front wall 144A and the upper end of the rear wall 144B.

The lower wall 105 extends rearward from the lower end of the front wall 101. The lower wall 105 is formed downward separate from the upper wall 104. As described above, the front portion of the lower wall 105 is connected with the lower end of the left wall 103. A left end portion of the lower wall 105 is flexed upward. The upper end of the flexed lower wall 105 is connected to the lower side of the aftermentioned inner wall 72 (see FIG. 5).

The rear wall 110 is formed rearward separate from the front wall 101. As described above, the upper end of the rear wall 110 is connected with the rear end of the upper wall 104. The lower end of the rear wall 110 is connected with the rear end of the lower wall 105. The left portion of the rear wall 110 is positioned in the rear of the right portion of the rear wall 110. An aftermentioned ink outflow passage 114 is formed in the left portion of the rear wall 110.

Figure 6:
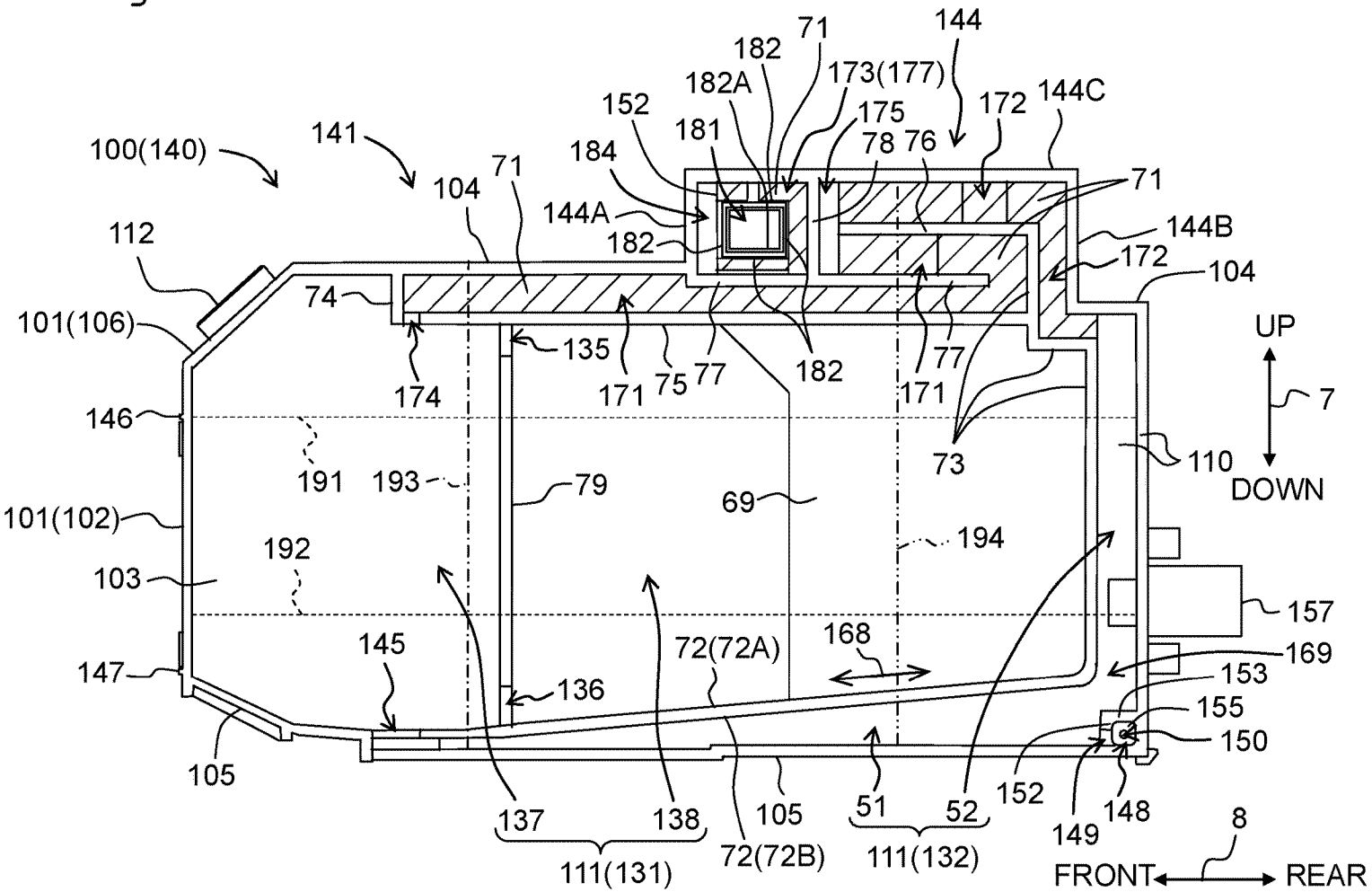
FIG. 6 is a right side view of the ink tank for the color ink.
Figure 7:
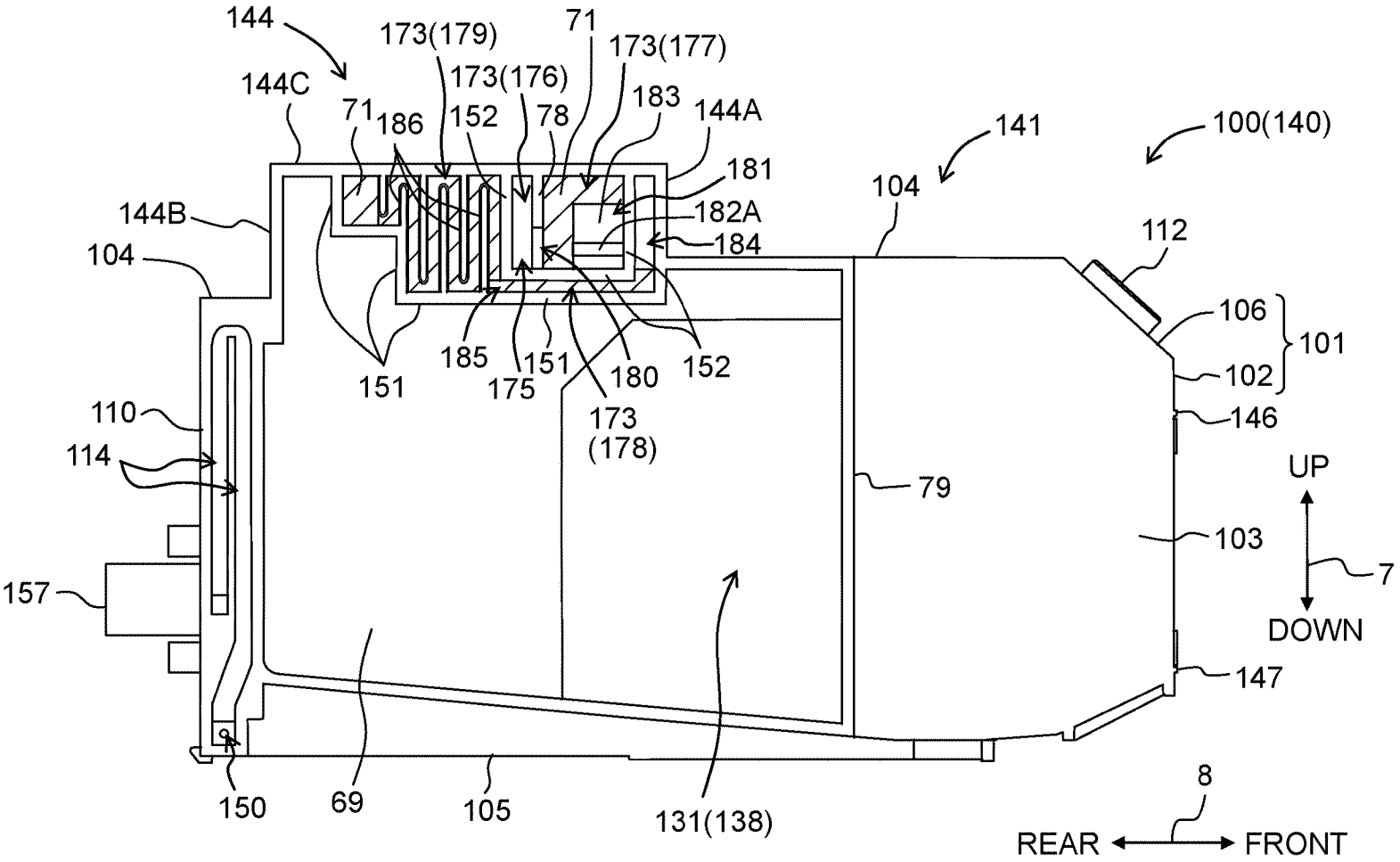
FIG. 7 is a left side view of the ink tank for the color ink.

As depicted in FIGS. 6 and 7, the inner wall 71 extends downward from the upper wall 104 and the upper wall 144C of the convex portion 144. The inner wall 71 extends in the up-down direction 7 and in the front-rear direction 8. The inner wall 71 is provided in the hatched area depicted in FIGS. 6 and 7. The inner wall 71 is provided at some position between the right end and the left end of the frame 141 along the left-right direction 9. For example, the inner wall 71 is provided in an approximately central portion of the frame 141 along the left-right direction 9. By virtue of this, the inside of the frame 141 is divided into the left part and the right part at the place where the inner wall 71 is provided. Further, the inner wall 71 may be provided at a position close to the right end of the frame 141 or at a position close to the left end of the frame 141. Further, because the inner wall 71 defines part of an aftermentioned communication passage, it is desirable to provide the inner wall 71 in a position not including the right end and the left end of the frame 141.

As depicted in FIGS. 4 and 5, the inner wall 72 (an example of the first partition wall, the second partition wall and the common partition wall) is provided in the vicinity of the lower wall 105 between the upper wall 104 and the lower wall 105 along the up-down direction 7. The inner wall 72 extends rearward while being inclined upward from a front end portion to a rear end portion of the lower wall 105. The front end of the inner wall 72 is connected with such a part of the lower wall 105 as on the front end portion side. The rear end of the inner wall 72 is positioned in front of the rear wall 110 and separate from the rear wall 110.

The inner wall 73 extends approximately upward from the rear end of the inner wall 72 while keeping a certain distance from the rear wall 110. The inner wall 73 extends into the convex portion 144 while being flexed to follow the outer shape of the convex portion 144. The upper end of the inner wall 73 is positioned below the upper wall 144C of the convex portion 144 and apart from the upper wall 144C. A part of the inner wall 73 (a portion below the aftermentioned inner wall 75) extends from the right end to the left end of the frame 141. On the other hand, the other part of the inner wall 73 extends from the right end of the frame 141 to the inner wall 71.

The inner wall 69 extends in the up-down direction 7 and in the front-rear direction 8. The inner wall 69 is positioned between the inner wall 72 and the aftermentioned inner wall 75 along the up-down direction 7. The inner wall 69 is positioned in front of the inner wall 73. The inner wall 69 is provided in an approximately central portion of the frame 141 along the left-right direction 9. By virtue of this, a rear ink chamber 138 of the aftermentioned first ink chamber 131 is divided into the left part and the right part at the place of providing the inner wall 69. The lower end of the inner wall 69 is connected to a rear portion of the inner wall 72. The upper end of the inner wall 69 is connected to a rear portion of the inner wall 75. The rear end of the inner wall 69 is connected to the inner wall 73.

The inner walls 74 to 77 explained below extend rightward from the inner wall 71 (see FIG. 6). In other words, the inner walls 74 to 77 extend from the inner wall 71 to the right end of the frame 141.

As depicted in FIGS. 4 to 6, the inner wall 74 extends downward in a front portion of a lower side 104A of the upper wall 104. The left end of the inner wall 74 is connected to the left wall 103 while the rear side of the inner wall 74 is connected with the front end of the inner wall 71.

The inner wall 75 extends rearward from the lower end of the inner wall 74. The rear end of the inner wall 75 is connected with the inner wall 73.

The inner wall 76 extends frontward from the upper end of the inner wall 73. That is, the inner wall 76 is positioned above the inner wall 75. The front end of the inner wall 76 is positioned in the rear of an aftermentioned through hole 175.

The inner wall 77 extends rearward from the lower end of the front wall 144A of the convex portion 144. A front portion of the inner wall 77 is positioned between the upper wall 144C of the convex portion 144 and the inner wall 75 along the up-down direction 7 to face the upper wall 144C of the convex portion 144 and the inner wall 75 along the up-down direction 7. The rear portion of the inner wall 77 is positioned between the inner wall 76 and the inner wall 75 along the up-down direction 7 to face the inner wall 76 and the inner wall 75 along the up-down direction 7. The rear end of the inner wall 77 is positioned in front of the inner wall 73 and apart from the inner wall 73.

The inner walls 78 and 79 explained below extend rightward and leftward from the inner wall 71 (see FIGS. 6 and 7). In other words, the inner walls 78 and 79 extend from the right end to the left end of the frame 141.

As depicted in FIGS. 4 and 5, the inner wall 78 extends in the up-down direction 7 and in the front-rear direction 8. The inner wall 78 is provided in the rear of the front wall 144A of the convex portion 144 to be separate from front wall 144A. As depicted in FIG. 6, the inner wall 78 faces the inner wall 76 across the through hole 175 along the front-rear direction 8. That is, the inner wall 78 is provided between the front wall 144A and the through hole 175 along the front-rear direction 8.

The inner wall 79 extends in the up-down direction 7 and in the left-right direction 9. The inner wall 79 is positioned in the rear of the inner wall 74 and in front of the inner wall 69. The upper end of the inner wall 79 is connected with the inner wall 75. The lower end of the inner wall 79 is connected with the inner wall 72. The left end of the inner wall 79 is connected with the left wall 103.

The inner walls 151 and 152 explained below extend leftward from the inner wall 71 (see FIG. 7). In other words, the inner walls 151 and 152 extend from the inner wall 71 to the left end of the frame 141.

As depicted in FIGS. 5 and 7, the inner wall 151 connects the lower end of the front wall 144A of the convex portion 144 and the rear portion of the upper wall 144C of the convex portion 144. The inner wall 151 extends rearward from the lower end of the front wall 144A, then extends upward, then extends rearward, then extends upward, and finally reaches the upper wall 144C.

The inner wall 152 connects two places of the upper wall 144C of the convex portion 144. Those two places are a front end portion of the upper wall 144C and a central portion of the upper wall 144C along the front-rear direction 8. The inner wall 152 extends downward from the lower side of the front end portion of the upper wall 144C, then extends rearward, then extends upward, and finally reaches the lower side of the central portion of the upper wall 144C along the front-rear direction 8. The inner wall 152 is enclosed by the upper wall 144C and the inner wall 151 as the ink tank 100 is viewed from the left.

As depicted in FIG. 4, the frame 141 is open at the right side. The right side of the frame 141 is sealed up by welding the film 142 on the right surfaces of the front wall 101, lower wall 105, rear wall 110, upper wall 104, inner walls 72 to 79, front wall 144A of the convex portion 144, rear wall 144B of the convex portion 144, and upper wall 144C of the convex portion 144.

As depicted in FIG. 5, the frame 141 is open at the left side in a rear portion. The left side of the frame 141 is sealed up by welding the film 143 on the left surfaces of the rear wall 110, upper wall 104, inner wall 72, inner wall 79, inner wall 151, inner wall 152, front wall 144A of the convex portion 144, rear wall 144B of the convex portion 144, upper wall 144C of the convex portion 144, and an aftermentioned partition wall 186.

As depicted in FIG. 4, the outer surface (front surface) of the upstanding wall 102 of the front wall 101 includes a first line 146 and a second line 147.

The first line 146 extends in the left-right direction 9. The first line 146 is positioned at the same height, along the up-down direction 7, as the liquid level of the ink when retained in the ink chamber 111 at the maximum retainable amount with the ink tank 100 in the usage posture. Further, the first line 146 is not limited to being positioned at the same height, along the up-down direction 7, as the liquid level of the ink when retained in the ink chamber 111 at that maximum amount.

The second line 147 extends in the left-right direction 9. The second line 147 is positioned below the first line 146. In detail, the second line 147 is positioned at the same height, along the up-down direction 7, as the liquid level of the ink when retained in the ink chamber 111 at a smaller amount than the maximum amount with the ink tank 100 in the usage posture. In this embodiment, the second line 147 is positioned at the same height, along the up-down direction 7, as the liquid level of the ink when retained in the ink chamber 111 at the minimum retained amount when it becomes necessary to refill the ink tank 100 with the ink with the ink tank 100 in the usage posture.

<Ink Chamber 111>

As depicted in FIGS. 4 and 5, the ink chamber 111 is formed inside the casing 140. The ink chamber 111 is an inner space of the ink tank 100 to retain the ink. The ink chamber 111 includes the first ink chamber 131 (an example of the first storage chamber) and the second ink chamber 132 (an example of the second storage chamber).

The first ink chamber 131 includes a space explained below, and a first communication passage 171 of an atmosphere communication passage in communication with that space. The second ink chamber 132 includes a space explained below, a second communication passage 172 of the atmosphere communication passage in communication with that space, a buffer chamber 148, and the ink outflow passage 114. Descriptions will be made later on about the atmosphere communication passage, the buffer chamber 148, and the ink outflow passage 114.

The first ink chamber 131 is defined by the front wall 101, the left wall 103, the lower wall 105, the rear wall 110, the inner wall 72, the inner wall 73, the inner wall 74, the inner wall 75, the upper wall 104, the inner wall 151, the upper wall 144C of the convex portion 144, the film 142, and the film 143. The front wall 101 defines the front side of the first ink chamber 131. The lower wall 105 and the inner wall 72 define the lower side of the first ink chamber 131. The inner wall 73 defines the rear side of the first ink chamber 131. The inner wall 75, the inner wall 74, and the upper wall 104 define the upper side of the first ink chamber 131. The film 142 defines the right side of the first ink chamber 131. The left wall 103 and the film 143 define the left side of the first ink chamber 131.

The inner wall 79 divides the first ink chamber 131 into a front ink chamber 137 and a rear ink chamber 138. The front side of the inner wall 79 defines the rear side of the front ink chamber 137. The rear side of the inner wall 79 defines the front side of the rear ink chamber 138.

Part of the upper end of the inner wall 79 is cut away leftward from the right end. By virtue of this, an opening 135 is formed at the upper end of the inner wall 79. The opening 135 is defined by the inner wall 79, the inner wall 75, and the film 142. Part of the lower end of the inner wall 79 is cut away leftward from the right end. By virtue of this, an opening 136 is formed at the lower end of the inner wall 79. The opening 136 is defined by the inner wall 79, the inner wall 72, and the film 142. The front ink chamber 137 and the rear ink chamber 138 are in communication with each other through the openings 135 and 136.

As depicted in FIGS. 4 and 6, the second ink chamber 132 is positioned below and in the rear of the first ink chamber 131. The second ink chamber 132 is approximately L-shaped as the ink tank 100 is viewed from the left. The second ink chamber 132 includes a lower ink chamber 51 (an example of the lower storage chamber) and an upper ink chamber 52 (an example of the upper storage chamber). The lower ink chamber 51 is positioned below the first ink chamber 131. The upper ink chamber 52 extends upward from a rear end portion of the lower ink chamber 51. The upper ink chamber 52 is positioned in the rear of the rear ink chamber 138 of the first ink chamber 131.

The lower ink chamber 51 is defined by the lower wall 105, the inner wall 72, and the film 142. The lower wall 105 defines the front side, lower side and left side of the lower ink chamber 51. The inner wall 72 defines the upper side of the lower ink chamber 51. The film 142 defines the right side of the lower ink chamber 51. The rear end of the lower ink chamber 51 is open. At this rear end, the lower ink chamber 51 is in communication with the upper ink chamber 52.

Part of the front end of the inner wall 72 is cut away leftward from the right end. By virtue of this, an opening 145 (an example of the communication port) is formed at the upper end of the inner wall 72. The opening 145 is defined by the inner wall 72, the lower wall 105, and the film 142. The front ink chamber 137 of the first ink chamber 131 is in communication with the lower ink chamber 51 of the second ink chamber 132 through the opening 145.

The upper ink chamber 52 is defined by the rear wall 110, the inner wall 73, and the film 142. The rear wall 110 defines the rear side and the left side of the upper ink chamber 52. The inner wall 73 defines the front side of the upper ink chamber 52. The film 142 defines the right side of the upper ink chamber 52. The lower end of the upper ink chamber 52 is open. The upper ink chamber 52 is in communication with the lower ink chamber 51 at that lower end.

The upper end of the upper ink chamber 52 is open. This upper end (a virtual side) mentioned here is at the same height as the first line 146. That is, that upper end is at the same height as the liquid level of the ink when retained in the ink chamber 111 at the maximum retainable amount with the ink tank 100 in the usage posture. Then, at the upper end, the upper ink chamber 52 is in communication with the second communication passage 172 of the aftermentioned atmosphere communication passage. That is, the upper end is the boundary between the upper ink chamber 52 and the second communication passage 172. Further, the boundary is not limited to the above position but may be, for example, above or below the first line 146.

With the ink tank 100 in the usage posture, in other words, with the upper wall 104 positioned at the upper side of the ink tank 100 and with the lower wall 105 positioned at the lower side of the ink tank 100, if the maximum retainable amount of the ink is retained in the ink chamber 111, then the ink level is positioned as depicted with a dashed line 191 in FIG. 6. That is, the ink level is, as described earlier on, at the same height as the first line 146.

On this occasion, the liquid level of the ink retained in the first ink chamber 131 is the same in vertical height (the height along the up-down direction 7) as the liquid level of the ink retained in the second ink chamber 132.

Further, on this occasion, the liquid level of the ink in the first ink chamber 131 is formed independently from the liquid level of the ink in the second ink chamber 132. In particular, the ink level in the first ink chamber 131 is enclosed by the front wall 101, the inner wall 73, the film 142, the left wall 103, and the film 143. On the other hand, the ink level in the second ink chamber 132 is enclosed by the rear wall 110, the inner wall 73, and the film 142.

Further, the fact that the ink level in the first ink chamber 131 is formed independently from the ink level in the second ink chamber 132 is not limited to the occasion when the ink chamber 111 retains the maximum retainable amount of the ink. For example, the ink level in the first ink chamber 131 may be formed independently from the ink level in the second ink chamber 132 when the ink chamber 111 retains such an amount of the ink as the liquid level of the ink is at the same height as the second line 147. Of course, the ink level in the first ink chamber 131 may be formed independently from the ink level in the second ink chamber 132 when the ink chamber 111 retains the maximum retainable amount of the ink, or when the ink chamber 111 retains such an amount of the ink that the ink level is at the same height as the second line 147, or when the ink chamber 111 retains another amount of the ink.

Further, even with the ink tank 100 not in the usage posture, the ink level in the first ink chamber 131 is formed independently from the ink level in the second ink chamber 132.

For example, with the lower wall 105 positioned at the upper side of the ink tank 100 and with the upper wall 104 positioned at the lower side of the ink tank 100, if the maximum retainable amount of the ink is retained in the ink chamber 111, then the ink level is positioned as depicted with a dashed line 192 in FIG. 6. That is, the ink level is positioned at the dashed line 193 present between the first line 146 and the second line 147 along the up-down direction 7.

Further, for example, with the front wall 101 positioned at the upper side of the ink tank 100 and with the rear wall 110 positioned at the lower side of the ink tank 100, if the maximum retainable amount of the ink is retained in the ink chamber 111, then the ink level is positioned as depicted with a chain line 193 in FIG. 6.

Further, for example, with the rear wall 110 positioned at the upper side of the ink tank 100 and with the front wall 101 positioned at the lower side of the ink tank 100, if the maximum retainable amount of the ink is retained in the ink chamber 111, then the ink level is positioned as depicted with a two-dot chain line 194 in FIG. 6.

<Buffer Chamber 148>

As depicted in FIGS. 4 and 6, the buffer chamber 148 is formed inside the casing 140. The buffer chamber 148 is another inner space of the ink tank 100 and interposed between the second ink chamber 132 and the aftermentioned ink outflow passage 114. That is, the ink retained in the second ink chamber 132 flows into the ink outflow passage 114 via the buffer chamber 148.

The buffer chamber 148 is provided at the rear lower right side of the casing 140. The buffer chamber 148 is defined by the inner wall 153, the inner wall 154, the inner wall 155, the lower wall 105, the rear wall 110, and the film 142.

The inner wall 153 projects frontward from the front side in a right lower portion of the rear wall 110 and extends in the left-right direction 9. The inner wall 153 defines the upper side of the buffer chamber 148. The inner wall 154 projects upward from the front side in a right rear portion of the lower wall 105 and extends in the left-right direction 9. The inner wall 154 defines the front side of the buffer chamber 148. The inner wall 155 extends in the up-down direction 7 and in the front-rear direction 8 and is enclosed by the inner wall 153, the inner wall 154, the rear wall 110, and the lower wall 105. The inner wall 155 defines the left side of the buffer chamber 148. The lower wall 105 defines the lower side of the buffer chamber 148. The rear wall 110 defines the rear side of the buffer chamber 148. The film 142 defines the right side of the buffer chamber 148.

Part of a lower right end portion of the inner wall 154 is cut away leftward from the right end. By virtue of this, an opening 149 (an example of the liquid outflow port) is formed in the lower right end portion of the inner wall 154. The opening 149 is defined by the inner wall 154 and the film 142. The opening 149 lets the buffer chamber 148 be in communication with a rear lower right part of the lower ink chamber 51 of the second ink chamber 132. Further, while the cutaway of the inner wall 154 is semicircular in this embodiment, the cutaway is not limited to a semicircular shape but may be, for example, rectangular.

A circular opening 150 is formed in a central portion of the inner wall 155. The opening 150 lets the buffer chamber 148 be in communication with the ink outflow passage 114. The ink retained in the second ink chamber 132 flows into the opening 150 via the buffer chamber 148. In other words, the opening 150 is an ink inflow port (an example of the liquid inflow port) for the ink to flow from the buffer chamber 148 to the ink outflow passage 114. Further, the opening 150 is not limited to a circular shape but may be, for example, rectangular or the like.

The film 142 defines part of the opening 149. Therefore, stable meniscus is not formable in the opening 149. In this embodiment, the opening 150 is formed in the inner wall 155 defining the buffer chamber 148. The opening 150 is defined by the inner wall 155 throughout the periphery. Hence, stable meniscus pressure resistance is brought in the opening 150. By virtue of this, stable meniscus is formed in the opening 150. As a result, with the ink tank 100 in any posture, it is possible to prevent air bubbles from entering the ink outflow passage 114 which will be explained below.

<Ink Outflow Passage 114>

As depicted in FIGS. 5 and 7, the casing 140 has the ink outflow passage 114. The ink outflow passage 114 is a communication passage for the ink retained in the second ink chamber 132 to flow out of the ink tank 100. Further, in this embodiment, because the ink retained in the first ink chamber 131 moves to the second ink chamber 132 via the opening 145, the ink outflow passage 114 may also be called a communication passage for the ink retained in the first ink chamber 131 and the second ink chamber 132 to flow out of the ink tank 100.

The ink outflow passage 114 is in communication with the buffer chamber 148 through the opening 150. The ink outflow passage 114 extends leftward from the opening 150, then extends upward, then extends downward, then extends rightward, and finally reaches an opening 156.

The ink outflow passage 114 is formed as a groove recessed rightward from the left surface of the rear wall 110. The ink outflow passage 114 is defined by the rear wall 110 except for part of the right side and the left side of the ink outflow passage 114. The inner wall 155 defines a surrounding portion of the opening 156 at the right side of the ink outflow passage 114. The film 143 defines the left side of the ink outflow passage 114.

The frame 141 includes a cylindrical projecting portion 157. The projecting portion 157 projects rearward from the surrounding portion of the opening 156 of the rear wall 110. Through the opening 156, the front end of the inner space of the projecting portion 157 is in communication with the ink outflow passage 114. An opening 158 lets the rear end of the inner space of the projecting portion 157 be in communication with the outside of the ink tank 100. The ink tube 32 is connected with the projecting portion 157 through the opening 158.

In the above manner, one end of the ink outflow passage 114 is in communication with the second ink chamber 132 through the buffer chamber 148. Further, the other end of the ink outflow passage 114 is in communication with the inner space of the projecting portion 157 and with the nozzles 40 of the recording head 39 through the ink tube 32. That is, the inflow ink from the opening 150 flows out of the opening 158 toward the recording head 39. Further, if ink droplets are jetted from the recording head 39 to consume the ink, then the ink inside the ink outflow passage 114 moves toward the recording head 39.

Here, the ink outflow passage 114 is a flow passage which is such a space that one end thereof is connected with the ink chamber 111 and, if the other end is blocked, then regardless of the posture of the ink tank 100, the ink retained in the ink chamber 111 does not flow into that space. In this embodiment, the ink tank 100 includes only the ink outflow passage 114 as a flow passage. However, the ink tank 100 may include other flow passages than the ink outflow passage 114.

As described earlier on, the pump blocks the tube extending from the cap of the maintenance mechanism capable of covering the nozzles 40 of the recording head 39. Hence, when the cap covers the nozzles 40, the other end of the ink outflow passage 114 (the end beside the projecting portion 157) is in communication with the blocked tube through the inner space of the projecting portion 157, the ink tube 32, the recording head 39, and the cap. That is, the other end of the ink outflow passage 114 is blocked. Then, the ink outflow passage 114 is configured to have a sufficiently smaller cross-sectional area than the second ink chamber 132. Therefore, even with the ink tank 100 in other postures than the usage posture, that is, regardless of the posture of the ink tank 100, the ink retained in the second ink chamber 132 will never flow into the ink outflow passage 114. Further, when the cap does not cover the nozzles 40, the nozzles 40 are open. That is, the other end of the ink outflow passage 114 is open. Hence, it is possible for the ink retained in the second ink chamber 132 to flow into the ink outflow passage 114.

On the other hand, the aforementioned opening 145 and the aftermentioned atmosphere communication passage are a boundary. The boundary refers to such a space that at least one end or the other end thereof is connected with the ink chamber 111 and, even if the one end or the other end is blocked, it is still possible for the ink retained in the ink chamber 111 to flow into that space. In this embodiment, the ink tank 100 includes only the opening 145 and the atmosphere communication passage as the boundary. However, the ink tank 100 may include another boundary than the opening 145 and the atmosphere communication passage.

<Inner Wall 72>

As depicted in FIGS. 4 and 6, the inner wall 72 includes an upper surface 72A facing upward (an example of the first surface) and a lower surface 72B (an example of the second surface) which is on the back of the upper surface 72A and faces downward.

The upper surface 72A forms the lower surface of the first ink chamber 131. The lower surface 72B forms the upper surface of the lower ink chamber 51 of the second ink chamber 132.

As described earlier on, the inner wall 72 extends rearward while inclining upward. The upper surface 72A and the lower surface 72B also extend rearward while inclining upward. The upper surface 72A and the lower surface 72B have such an inclination direction as having components of the front-rear direction 8 and the up-down direction 7, and being depicted in FIG. 6 with an arrow 168.

The opening 145 is formed in front right end portions of the upper surface 72A and the lower surface 72B. That is, the opening 145 is formed in the upper surface 72A and the lower surface 72B. As described above, the upper surface 72A and the lower surface 72B extend rearward while inclining upward. Therefore, the upper surface 72A and the lower surface 72B are lowermost in position at their front ends and uppermost in position at their rear ends. Hence, the opening 145 provided in the front end portions of the upper surface 72A and the lower surface 72B is positioned at the lowermost ends of the upper surface 72A and the lower surface 72B.

Further, as described earlier on, the upper ink chamber 52 extends upward from the rear end of the lower ink chamber 51. That is, a boundary position 169 between the upper ink chamber 52 and the lower ink chamber 51 is in the vicinity of the rear end of the lower surface 72B. Hence, that boundary is positioned at the uppermost end of the lower surface 72B.

In the above manner, the upper surface 72A is inclined such that the opening 145 may be formed in position at the lowermost end. Further, the lower surface 72B is inclined such that the opening 145 may be formed in position at the lowermost end while the boundary between the lower ink chamber 51 and the upper ink chamber 52 may be positioned at the uppermost end.

The opening 145 is provided in a front end portion of the lower ink chamber 51. In other words, the opening 145 is provided in the lower ink chamber 51 at the front end side of the lower surface 72B (an example of the one end side). Further, the opening 149 is formed in a rear end portion of the lower ink chamber 51. In other words, the opening 149 is formed in the lower ink chamber 51 at the rear end side of the lower surface 72B (an example of the other end side).

<Atmosphere Communication Passage>

As depicted in FIGS. 4 to 7, the casing 140 has the atmosphere communication passage for communication between the ink chamber 111 and the outside of the ink tank 100. In other words, the atmosphere communication passage serves for opening the ink chamber 111 to the atmosphere. The atmosphere communication passage includes, as depicted in FIGS. 4 and 6, the first communication passage 171, the second communication passage 172, and a third communication passage 173 depicted in FIGS. 4 to 7. The first communication passage 171 and the second communication passage 172 are positioned on the right side of the inner wall 71. The third communication passage 173 is positioned on both the right side and the left side of the inner wall 71.

As depicted in FIGS. 4 and 6, the first communication passage 171 is in communication with the front ink chamber 137 of the first ink chamber 131 through an opening 174. The opening 174 is formed by cutting away a right front end portion of the inner wall 75 leftward from the right end. The opening 174 is defined by the inner wall 75, the inner wall 74, and the film 142.

The first communication passage 171 extends rearward from the opening 174, then U-turns to extend frontward, and finally reaches a through hole 175 (see FIGS. 6 and 7). The through hole 175 is provided in the inner wall 71. The through hole 175 is provided a little frontward from the center of the convex portion 144 along the front-rear direction 8. The through hole 175 renders communication between the right side and the left side of the inner wall 71.

The upper and lower sides and the front and rear sides of the first communication passage 171 are defined by the upper wall 104, the inner wall 73, the inner wall 74, the inner wall 75, the inner wall 76, and the inner wall 77. Further, the left side of the first communication passage 171 is defined by the inner wall 71 while the right side is defined by the film 142.

The second communication passage 172 is, at the lower end, in communication with the upper end (virtual side) of the upper ink chamber 52 of the second ink chamber 132. The second communication passage 172 extends upward from the position in communication with the upper ink chamber 52, then extends frontward, then extends upward, then extends frontward, and finally reaches the through hole 175.

The rear side and the upper side of the second communication passage 172 are defined by the rear wall 110, the upper wall 104, the rear wall 144B of the convex portion 144, and the upper wall 144C of the convex portion 144. Further, the front side and the lower side of the second communication passage 172 are defined by the inner wall 73 and the inner wall 76. Further, the left side of the second communication passage 172 is defined by the inner wall 71 while the right side is defined by the film 142.

As depicted in FIGS. 5 and 7, the third communication passage 173 includes a left communication passage 176, a right communication passage 177, a rear communication passage 178, and a labyrinth 179.

The left communication passage 176 extends leftward from the through hole 175 (see FIGS. 6 and 7) to the left end of the frame 141. The left communication passage 176 is in communication with the first communication passage 171 and the second communication passage 172 through the through hole 175. The left communication passage 176 is in communication with the right communication passage 177 through an opening 180. The opening 180 is formed by cutting away the lower end of the inner wall 78 rightward from the left end. The opening 180 is defined by the inner wall 78, the inner wall 152, and the film 143.

The front side of the left communication passage 176 is defined by the inner wall 78 while the rear side and the lower side are defined by the inner wall 152. The upper side is defined by the upper wall 144C of the convex portion 144 while the left side is defined by the film 143.

The right communication passage 177 extends rightward from the opening 180 to the right end of the frame 141. As depicted in FIGS. 4, 6 and 7, an opening 181 is formed in a portion of the inner wall 71 where the right communication passage 177 is formed. The opening 181 renders communication between the left side and the right side of the inner wall 71 of the right communication passage 177.

As depicted in FIG. 4, a surrounding wall 182 projects rightward from the periphery of the opening 181 in the inner wall 71. A lower inner side 182A of the surrounding wall 182 is inclined such that the right end may be positioned above the left end. A semipermeable membrane 183 (see FIG. 4) is attached to the projecting end surface of the surrounding wall 182, that is, the right surface of the surrounding wall 182. By virtue of this, the right communication passage 177 is blocked by the semipermeable membrane 183.

The semipermeable membrane 183 is a porous film having tiny poles blocking the ink from passing but allowing gases to pass therethrough. For example, the semipermeable membrane 183 is formed of a fluorine resin such as polytetrafluoroethylene, polychlorotrifluoroethylene, a tetrafluoroethylene-hexafluoropropylene copolymer, a tetrafluoroetylene-perfluoroalkylvinylether copolymer, a tetrafluoroetylene-ethylene copolymer, or the like.

As depicted in FIGS. 5 and 7, the inner wall 152 defines the front side and the lower side of the right communication passage 177 on the left side of the inner wall 71, the inner wall 78 defines the rear side, the upper wall 144C of the convex portion 144 defines the upper side, the inner wall 71 (see FIG. 6) defines the right side excluding the part of the opening 181, and the film 143 defines the left side.

Further, as depicted in FIGS. 4 and 6, the front wall 144A of the convex portion 144 defines the front side of the right communication passage 177 on the right side of the inner wall 71, the inner wall 77 and the lower inner side 182A of the surrounding wall 182 define the lower side, the inner wall 78 defines the rear side, the upper wall 144C of the convex portion 144 defines the upper side, the inner wall 71 defines the left side excluding the part of the opening 181, and the film 142 defines the right side.

As depicted in FIGS. 5 and 7, the rear communication passage 178 is in communication with such a portion of the right communication passage 177 as on the right side of the inner wall 71 through an opening 184 (see FIGS. 6 and 7) formed between the front wall 144A of the convex portion 144 and the inner wall 71. The rear communication passage 178 extends leftward from the opening 184, then extends rearward, and finally reaches the labyrinth 179 through an opening 185 formed between the inner wall 151 and the inner wall 152.

The inner wall 151 and the front wall 144A of the convex portion 144 define the lower side and the front side of the rear communication passage 178, the inner wall 152 defines the rear side and the upper side, the inner wall 71 defines the right side, and the film 143 defines the left side.

The labyrinth 179 is a communication passage extending along the front-rear direction 8 and repeating U-turns in the up-down direction 7 by providing a plurality of partition walls 186 extending in the up-down direction 7 to align in the front-rear direction 8. One end (the front lower end) of the labyrinth 179 is in communication with the rear communication passage 178 through the opening 185. The other end (the rear upper end) of the labyrinth 179 is in communication with an atmosphere opening port 187 (see FIG. 5).

The atmosphere opening port 187 is configured as a hole penetrating the upper wall 144C of the convex portion 144 along the up-down direction 7. The lower end of the atmosphere opening port 187 is in communication with the labyrinth 179. The upper end of the atmosphere opening port 187 is in communication with the outside of the ink tank 100. With the ink tank 100 in the usage posture, the atmosphere opening port 187 is positioned above the ink level when the ink chamber 111 retains the maximum retainable amount of the ink.

In the above manner, as depicted in FIG. 4, the atmosphere communication passage is in communication with the first ink chamber 131 of the ink chamber 111 through the opening 174, and in communication with the second ink chamber 132 of the ink chamber 111 at the lower end of the second communication passage 172. On the other hand, as depicted in FIG. 5, the atmosphere communication passage is in communication with the outside of the ink tank 100 through the atmosphere opening port 187.

<Ink Tank 100B>

Figure 8:
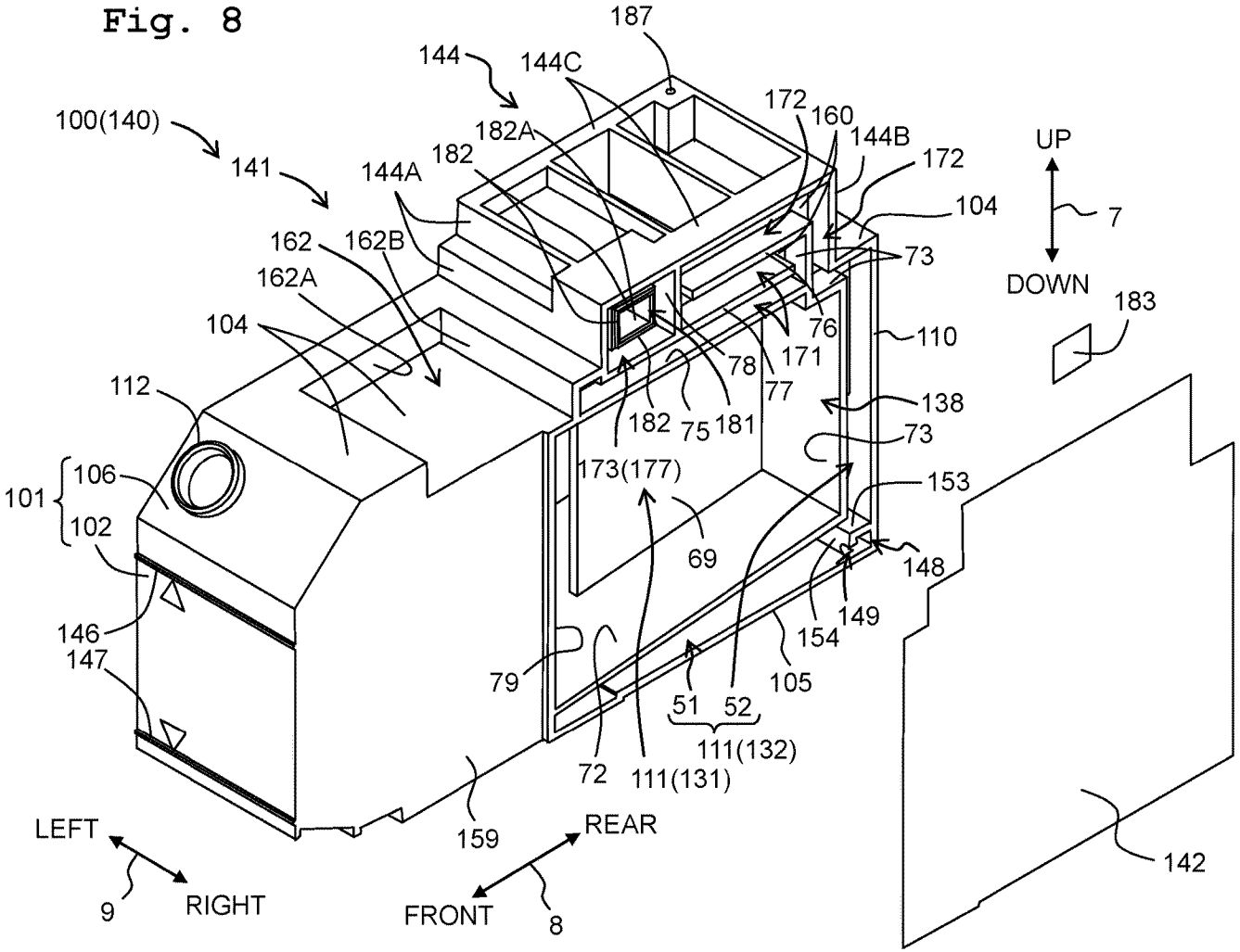
FIG. 8 is a front perspective view of an ink tank for a black ink.
Figure 9:
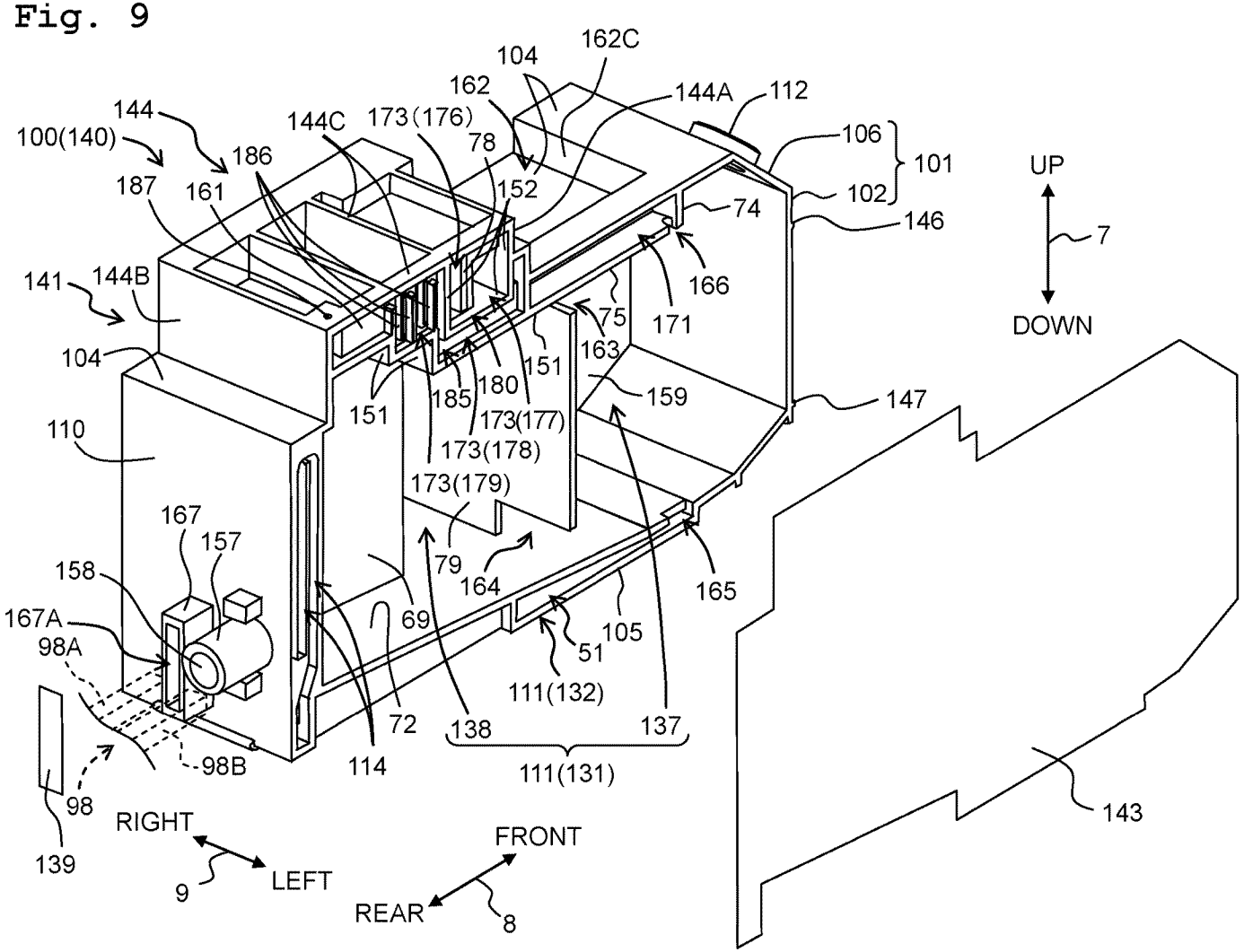
FIG. 9 is a rear perspective view of the ink tank for the black ink.

Referring to FIGS. 8 to 11, a configuration of the ink tank 100B will be explained below. As depicted in FIGS. 8 and 9, the ink tank 100B is longer than the ink tanks 100Y, 100C, and 100M along the left-right direction 9 (see FIGS. 4 and 5).

The ink tank 100B will be explained below about the different aspects from the ink tanks 100Y, 100C, and 100M. Further, the same components of the ink tank 100B as those of the ink tanks 100Y, 100C, and 100M are each assigned with the same numeral or alphanumeral as in FIGS. 4 to 7, and any explanation therefor will be omitted. Further, if the configuration of a certain part of the ink tank 100B differs from the configuration of the corresponding parts of the ink tanks 100Y, 100C, and 100M to that certain part only in the aspect of being longer along the left-right direction 9, then such part of the ink tank 100B as to correspond to the certain part is assigned with the same numeral or alphanumeral as in FIGS. 4 to 7, and any explanation therefor will be omitted.

As depicted in FIGS. 8 and 9, the casing 140 of the ink tank 100B includes a frame 141, three films 139, 142, and 143.

Figure 10:
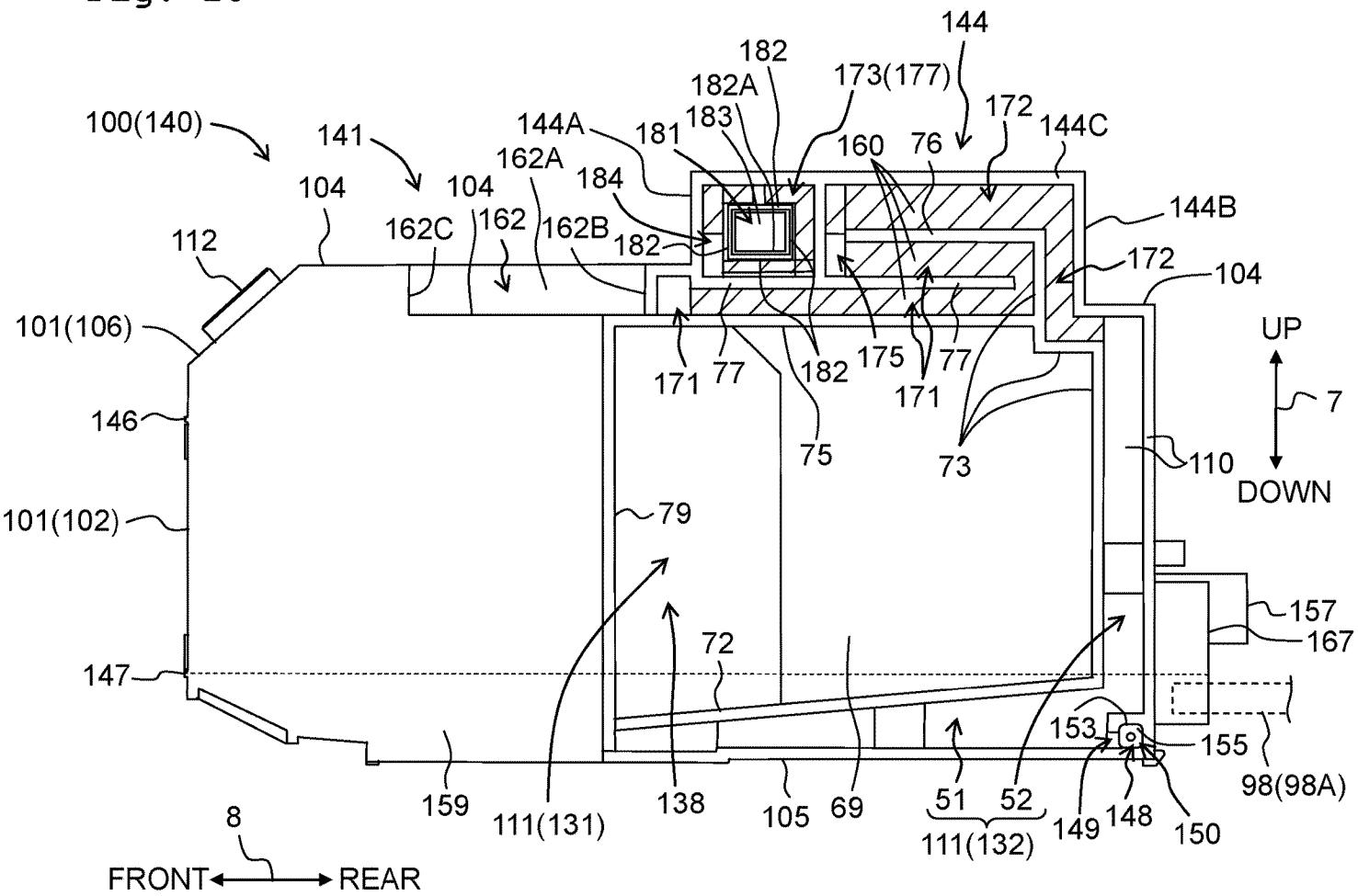
FIG. 10 is a right side view of the ink tank for the black ink.

As depicted in FIGS. 8 and 10, the ink tank 100B includes a right wall 159 but does not include the left wall 103 (see FIG. 5) included in the ink tanks 100Y, 100C, and 100M. The right wall 159 extends rearward from the right end of the front wall 101. The upper end of the right wall 159 is connected with a front portion of the upper wall 104. The lower end of the right wall 159 is connected with a front portion of the lower wall 105. In other words, the right wall 159 connects the right end of the front wall 101, the front right end of the upper wall 104, and the front right end of the lower wall 105. That is, the right wall 159 is provided only in the front portion of the frame 141 and not provided in the rear portion of the frame 141.

As depicted in FIGS. 8 and 9, a recessed portion 162 is formed in a front portion of the upper wall 104. The recessed portion 162 is defined by lateral walls 162A, 162B and 162C, and the upper wall 104.

The ink tank 100B is not provided with the inner wall 71 (see FIG. 6). The ink tank 100B includes an inner wall 160

(see FIGS. 8 and 10) and an inner wall 161 (see FIGS. 9 and 11) as the walls corresponding to the inner wall 71 (see FIG. 6).

The inner wall 160 and the inner wall 161 extend downward from the upper wall 104 and the upper wall 144C of the convex portion 144. The inner wall 160 and the inner wall 161 extend in the up-down direction 7 and in the front-rear direction 8.

The inner wall 160 is provided within the hatched area depicted in FIG. 10. The inner wall 160 is provided at some position between the right end and the left end of the frame 141 along the left-right direction 9. For example, the inner wall 160 is provided on the right side of the center of the frame 141 along the left-right direction 9.

Figure 11:
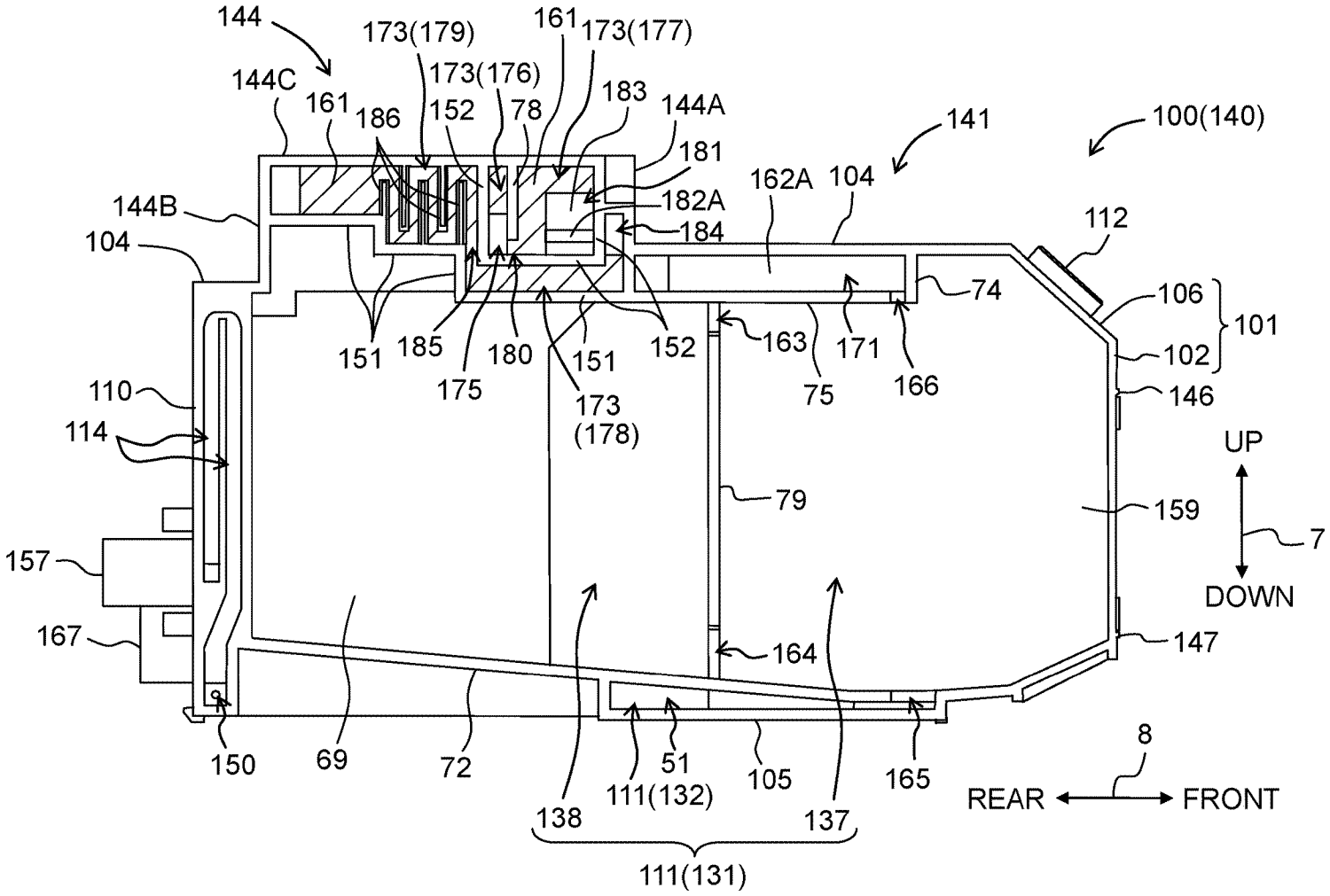
FIG. 11 is a left side view of the ink tank for the black ink.

The inner wall 161 is provided within the hatched area depicted in FIG. 11. The inner wall 161 is provided at some position on the left side of the inner wall 160 between the right end and the left end of the frame 141 along the left-right direction 9. For example, the inner wall 161 is provided on the left side of the center of the frame 141 along the left-right direction 9.

As depicted in FIGS. 8 and 10, the part of the inner wall 73 above the inner wall 75, the part of the inner wall 75 beside the inner wall 73, the inner wall 76, and the inner wall 77 extend rightward from the inner wall 160. That is, the part of the inner wall 73 above the inner wall 75, the part of the inner wall 75 beside the inner wall 73, the inner wall 76, and the inner wall 77 are provided on the right side of the inner wall 160.

As depicted in FIGS. 9 and 11, the inner wall 74 and the part of the inner wall 75 beside the inner wall 74 extend leftward from the lateral wall 162A. That is, the inner wall 74 and the part of the inner wall 75 beside the inner wall 74 are provided on the left side of the lateral wall 162A.

As depicted in FIGS. 9 and 11, the inner wall 74 extends downward from a front left portion of the upper wall 104. The inner wall 74 is not connected with the inner wall 160 and the inner wall 161 but connected with the lateral wall 162A.

The inner wall 75 extends rearward from the lower end of the inner wall 74. This rearward extending portion of the inner wall 75 extends leftward from the lateral wall 162A. Then, the inner wall 75 extends rightward. This rightward extending portion of the inner wall 75 is connected with the lateral wall 162B (see FIG. 8) at the front end and connected with the front wall 144A of the convex portion 144 (see FIGS. 8 and 11) at the rear end. Then, the inner wall 75 extends rearward. This rearward extending portion of the inner wall 75 extends rightward from the inner wall 160.

As depicted in FIGS. 8 and 10, the right end of the inner wall 79 is connected with the right wall 159.

As depicted in FIGS. 9 and 11, the inner wall 151 connects the lower end of the front wall 144A of the convex portion 144 and the rear wall 144B of the convex portion 144. The inner wall 151 extends rearward from the lower end of the front wall 144A, then extends upward, then extends rearward, then extends upward, then extends rearward, and finally reaches the rear wall 144B.

As depicted in FIG. 8, the rear portion of the right side of the frame 141 is open. The right side of the frame 141 is sealed up by welding the film 142 to the right surfaces of the lower wall 105, the rear wall 110, the upper wall 104, the inner walls 72, 73, the inner walls 75 to 79, the lateral wall 162B of the recessed portion 162, the front wall 144A of the convex portion 144, the rear wall 144B of the convex portion 144, and the upper wall 144C of the convex portion 144.

As depicted in FIG. 9, the left side of the frame 141 is open. The left side of the frame 141 is sealed up by welding the film 143 to the left surfaces of the rear wall 110, the upper wall 104, the lower wall 105, the inner wall 72, the inner wall 74, the inner wall 75, the inner wall 78, the inner wall 79, the inner wall 151, the inner wall 152, the front wall 144A of the convex portion 144, the rear wall 144B of the convex portion 144, the upper wall 144C of the convex portion 144, and the partition wall 186.

As depicted in FIGS. 8 and 9, the first ink chamber 131 is defined by the front wall 101, the right wall 159, the lower wall 105, the rear wall 110, the inner wall 72, the inner wall 73, the inner wall 74, the inner wall 75, the upper wall 104, the inner wall 151, the film 142, and the film 143. The right wall 159 and the film 142 define the right side of the first ink chamber 131.

As depicted in FIG. 9, part of the upper end of the inner wall 79 is cut away rightward from the left end. By virtue of this, an opening 163 is formed at the upper end of the inner wall 79. The opening 163 is defined by the inner wall 79, the inner wall 75, and the film 143. Part of the lower end of the inner wall 79 is also cut away rightward from the left end. By virtue of this, an opening 164 is formed at the upper end of the inner wall 79. The opening 164 is defined by the inner wall 79, the inner wall 72, and the film 143. The front ink chamber 137 is in communication with the rear ink chamber 138 through the openings 163 and 164.

Part of the front end of the inner wall 72 is cut away rightward from the left end. By virtue of this, an opening 165 is formed at the front end of the inner wall 72. The opening 165 is defined by the inner wall 72, the lower wall 105, and the film 143. The front ink chamber 137 of the first ink chamber 131 is in communication with the lower ink chamber 51 of the second ink chamber 132 through the opening 165.

As depicted in FIGS. 8 and 10, the first communication passage 171 and the second communication passage 172 are positioned on the right side of the inner wall 160. As depicted in FIGS. 8 to 11, the third communication passage 173 is positioned on both the right side of the inner wall 160 and on the left side of the inner wall 161.

As depicted in FIG. 9, the first communication passage 171 is in communication with the front ink chamber 137 of the first ink chamber 131 through an opening 166. The opening 166 is formed by cutting away part of a front left end portion of the inner wall 75 rightward from the left end. The opening 166 is defined by the inner wall 75, the inner wall 74, and the film 143.

The first communication passage 171 extends rearward from the opening 166, and then extends rightward. Then, as depicted in FIG. 8, the first communication passage 171 extends rearward, then U-turns to extend frontward, and finally reaches the through hole 175 (see FIG. 10). The through hole 175 penetrates the inner wall 160 and the inner wall 161 along the left-right direction 9 to connect the first communication passage 171, the second communication passage 172, and the third communication passage 173.

As depicted in FIG. 9, the part of the first communication passage 171 extending rearward from the opening 166 is defined by the upper wall 104, the lateral wall 162A of the recessed portion 162, the inner wall 74, the inner wall 75, and the film 143. The part of the first communication passage 171 extending rightward is defined by the upper wall 104, the lateral wall 162B of the recessed portion 162, the inner wall 75, and the front wall 144A of the convex portion 144. As depicted in FIG. 8, the part of the first communication passage 171 on the right side of the inner wall 160 is defined by the inner wall 160, the inner wall 73, the inner wall 75, the inner wall 76, the inner wall 77, and the film 142.

As depicted in FIG. 9, the frame 141 includes a projecting portion 167 projecting rearward from the rear wall 110. The projecting portion 167 is irradiated with light by an after-mentioned optical sensor 98 to detect the height of the liquid level of the ink retained in the ink chamber 111 of the ink tank 100 in the usage posture. The projecting portion 167 has a cuboid shape. The projecting portion 167 has an inner space 167A, and the front end and the rear end of the projecting portion 167 are open. The front end of the inner space 167A of the projecting portion 167 is in communication with the upper ink chamber 52 of the second ink chamber 132. That is, the inner space 167A is provided in the second ink chamber 132. The rear end of the projecting portion 167 is open. The open rear end of the projecting portion 167 blocked by attaching a film 139 thereto.

When viewing from above the horizontal cross section of the ink tank 100 at the height below the upper end and above the lower end of the inner space 167A of the projecting portion 167, the cross-sectional area of the second ink chamber 132 is smaller than the cross-sectional area of the first ink chamber 131. Then, the inner space 167A of the projecting portion 167 is in communication with the second ink chamber 132 smaller in cross-sectional area.

Further, in this embodiment, the inner space 167A of the projecting portion 167 is in communication with the second ink chamber 132. However, the inner space 167A may be in communication with the first ink chamber 131. That is, the inner space 167A may be provided in the first ink chamber 131. In this case, the projecting portion 167 may project, for example, from the front wall 101 or the left wall 103.

Further, in this embodiment, the projecting portion 167 is provided on the ink tank 100B only, among the ink tanks 100B, 100Y, 100C, and 100M. However, the projecting portion 167 may be provided on at least one of the ink tanks 100B, 100Y, 100C, and 100M.

<Optical Sensor 98>

The printer unit 11 includes the optical sensor 98. The optical sensor 98 is fitted on the casing 14. As depicted by the dashed lines in FIG. 9, the optical sensor 98 is positioned on the right side and the left side of the projecting portion 167 of the frame 141 of the ink tank 100B, with the tank set 99 disposed in the casing 14.

The optical sensor 98 includes a light emitting portion 98A and a light receiving portion 98B. The light emitting portion 98A and the light receiving portion 98B are arranged to interpose the projecting portion 167 therebetween along the left-right direction 9. The light emitting portion 98A is positioned on the right side of the projecting portion 167. The light receiving portion 98B is positioned on the left side of the projecting portion 167. Further, the light emitting portion 98A and the light receiving portion 98B may be reversed in position between the left side and the right side.

The positions for arranging light emitting portion 98A and the light receiving portion 98B are determined such that the second line 147 may not be lower than the position for the light emitting portion 98A to irradiate the light receiving portion 98B with the light, and the position for the light receiving portion 98B to receive the light from the light emitting portion 98A. In this embodiment, as depicted in FIG. 10, the optical sensor 98 is positioned below the second line 147. That is, the dashed line depicted in FIG. 10 is higher than the position corresponding to the optical path of the light radiated from the optical sensor 98 in the projecting portion 167. Here, that dashed line indicates the liquid level of the minimum retained amount of the ink when it becomes necessary to refill the ink tank in the usage posture with the ink. In the above manner, the position of the projecting portion 167 along the up-down direction 7 includes positions below the second line 147.

The optical sensor 98 is electrically connected to a controller (not depicted) of the multifunction peripheral 10 via an electric circuit.

The light is radiated from the light emitting portion 98A toward the light receiving portion 98B. The radiated light is transmitted through the projecting portion 167 to enter the inner space 167A of the projecting portion 167. If the liquid level of the ink stored in the inner space 167A is above the optical path, then the light is blocked by the ink stored in the inner space 167A so as not to reach the light receiving portion 98B. By virtue of this, a low level signal is outputted from the optical sensor 98 to the controller. On the other hand, if the liquid level of the ink is below the optical path, then the light proceeds through the air in the inner space 167A. In this case, the light is transmitted through the inner space 167A to reach the light receiving portion 98B. By virtue of this, a high level signal is outputted from the optical sensor 98 to the controller.

If the signal outputted from the optical sensor 98 is at the low level, then the controller determines that the liquid level of the ink retained in the ink chamber 111 is higher than the second line 147, whereas if the signal outputted from the optical sensor 98 is at the high level, then the controller determines that the liquid level of the ink retained in the ink chamber 111 is lower than the second line 147.

<Inlet 112>

As depicted in FIG. 1B, the inclined walls 106 of the ink tanks 100B, 100Y, 100C, and 100M are provided respectively with inlets 112B, 112Y, 112C, and 112M (which may be collectively referred to as "inlet 112") for filling the first ink chamber 131 of the ink chamber 111 with the ink. The inlet 112 (an example of the liquid inlet) penetrates the inclined wall 106 along the thickness direction to let the corresponding first ink chamber 131 be in communication with the outside of the ink tank 100. The inner surface of the inclined wall 106 faces the front ink chamber 137 of the first ink chamber 131. The outer surface of the inclined wall 106 faces the outside of the ink tank 100. Hence, the inlet 112 lets the first ink chamber 131 be in direct communication with the outside of the ink tank 100. That is, in this embodiment, the inlet 112 is provided in the first ink chamber 131 without the projecting portion 167. Further, the inlet 112 may be provided for filling the second ink chamber 132 with the ink.

The inclined wall 106 and the inlet 112 provided in the inclined wall 106 are exposed to the outside of the multi-function peripheral 10 through the opening 22 by letting the cover 70 in the opened position. The ink tank 100 is in the usage posture (the filling posture) when the first ink chamber 131 is being filled with the ink through the inlet 112. That is, if the ink tank 100 is in the usage posture, then the first ink chamber 131 can be filled with the ink through the inlet 112.

<Cap 113>

As depicted in FIGS. 1A and 1B, the ink tank 100 has caps 113B, 113Y, 113C, and 113M removable from the inclined walls 106 for blocking the inlets 112. The four caps 113B, 113Y, 113C, and 113M correspond respectively to the four inlets 112B, 112Y, 112C, and 112M of the ink tank 100. As depicted in FIG. 1A, the cap 113 fitted on the inclined wall 106 is attached tightly to the wall surface defining the periphery of the inlet 112 to block the inlet 112. On the other hand, as depicted in FIG. 1B, the cap 113 removed from the inclined wall 106 opens the inlet 112.

With the cover 70 in the opened position, the cap 113 is removed from the inclined wall 106. Further, by removing the cap 113 from the inlet 112, the ink chamber 111 is fillable with the ink through the inlet 112.

<Cover 70>

As depicted in FIGS. 1A and 1B, the cover 70 is provided to be capable of opening and closing the opening 22 formed in the front wall 14A of the casing 14. The cover 70 revolves about a revolving shaft 70A extending along the left-right direction 9. The cover 70 has such an outer shape as sized to correspond to the opening 22, and is shaped into a box open toward the opening 22. In the closed position, the cover 70 covers the upstanding wall 102 and the inclined wall 106 of the front wall 101 of the ink tank 100. In the opened position, the cover 70 exposes the upstanding wall 102 and the inclined wall 106 of the front wall 101 of the ink tank 100 to the outside of the casing 14.

[Function and Effect of Embodiment]

According to the above embodiment, the upper surface 72A of the inner wall 72 is inclined such that the opening 145 may be formed in position at the lowermost end. Therefore, it is possible to cause the total amount of the ink retained in the first ink chamber 131 to flow into the second ink chamber 132 through the opening 145. As a result, it is possible to reduce the amount of the ink remaining in the ink tank 100.

Further, according to the above embodiment, the lower surface 72B of the inner wall 72 is inclined such that the opening 145 may be formed in position at the lowermost end while the boundary position 169 between the lower ink chamber 51 and the upper ink chamber 52 may be positioned at the uppermost end. By virtue of this, even if some air bubbles could enter the second ink chamber 132 through the opening 145, those air bubbles would move along the lower surface 72B into the upper ink chamber 52. As a result, it is possible to reduce the possibility for the air bubbles to reach to the opening 149 provided in the lower portion of the lower ink chamber 51.

Further, according to the above embodiment, because the inner wall 72 also plays the role of a first partition wall defining the first ink chamber 131 and the role of a second partition wall defining the second ink chamber 132, it is possible to simplify the internal construction of the casing 140.

Further, according to the above embodiment, the opening 145 and the opening 149 are formed respectively at the front end side and the rear end side of the lower ink chamber 51. Therefore, it is possible to lengthen the distance along the inclination direction (the direction of the arrow 168) between the opening 145 and the opening 149. Further, because the lower surface 72B of the inner wall 72 is inclined upward from the front end side toward the rear end side, the height from the lower wall 105 to the lower surface 72B reaches its vertex in the vicinity of the opening 149. Hence, it is possible to reduce the possibility for the air bubbles moving along the lower surface 72B from the opening 145 to reach to the opening 149.

Further, it is preferable for the first ink chamber 131 to have a large volume. By narrowing the inclined angle of the inner wall 72 to the front-rear direction 8 and lowering the position of the rear end of the inner wall 72, it is possible to increase the volume of the first ink chamber 131. That is, it is preferable for the inner wall 72 to have the minimum inclined angle to the front-rear direction 8. The minimum inclined angle is such an angle as determined under several conditions such as the placement angle of the multifunction peripheral 10, the property value of the ink, the material of the inner wall 72, the surface roughness of the upper surface 72A of the inner wall 72, and the like.

Further, according to the above embodiment, the inclination direction (the direction of the arrow 168) has the longest component of the front-rear direction 8 among the components of the up-down direction 7, the front-rear direction 8 and the left-right direction 9. Therefore, it is possible to lengthen the distance between the opening 145 and the opening 149.

[Modified Embodiments]

According to the above embodiment, the inclination direction of the inner wall 72 has the components of the front-rear direction 8 and the up-down direction 7, depicted in FIG. 6 with the arrow 168. However, without being limited to this direction, the inner wall 72 may extend, for example, leftward while inclining upward. That is, the inclination direction of the upper surface 72A and the lower surface 72B may have components of the left-right direction 9 and the up-down direction 7. Further, for example, the inclination direction of the inner wall 72 may be inclined upward as apart from the opening 145 along a radial direction about the opening 145. In other words, the inner wall 72 may be shaped like a funnel with the opening 145 as the lower end and the center.

Further, according to the above embodiment, the inner wall 72 is an example of the first partition wall defining the first ink chamber 131 and the second partition wall defining the second ink chamber 132. That is, the first partition wall and the second partition wall are configured as one common partition wall. However, the first partition wall and the second partition wall may be configured as separate walls.

Figure 12:
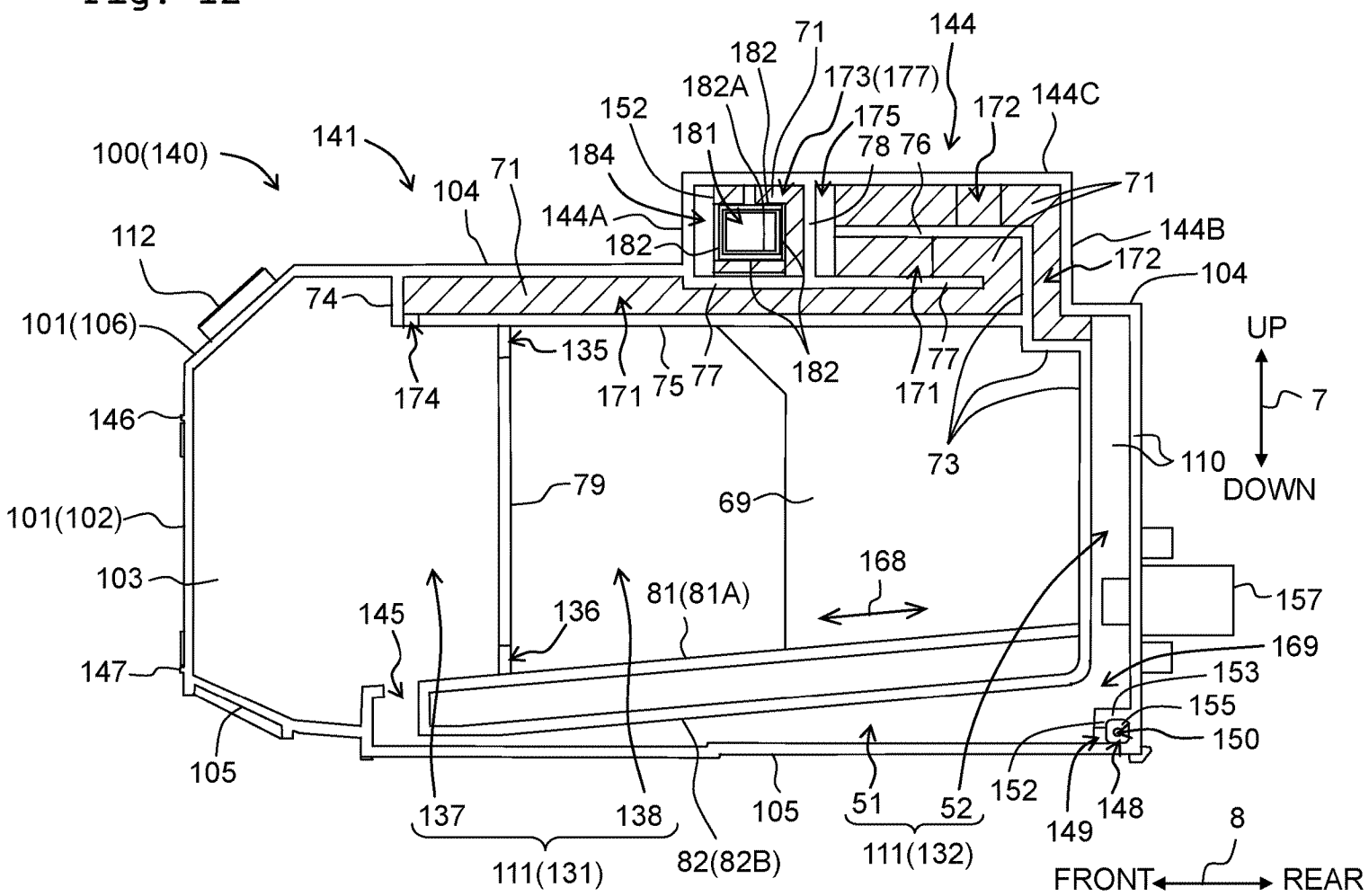
FIG. 12 is a right side view of an ink tank for the color ink according to a modification.

As depicted in FIG. 12, for example, the first partition wall defining the first ink chamber 131 may be an inner wall 81 while the second partition wall defining the second ink chamber 132 may be an inner wall 82. In this case, an upper surface 81A of the inner wall 81 (an example of the first surface) forms the lower surface of the first ink chamber 131 while a lower surface 82A of the inner wall 82 (an example of the second surface) forms the upper surface of the lower ink chamber 51 of the second ink chamber 132.

Further, each component of the ink tank 100 is not limited to the arrangement position described above. In the above embodiment, for example, as depicted in FIG. 4 and the like, the opening 145 is formed in the front right end portion of the inner wall 72 while the opening 149 is formed in the rear end portion of the lower ink chamber 51. However, without being limited to this arrangement, the opening 145 may be formed in a central portion of the inner wall 72 along the front-rear direction 8 while the opening 149 may be formed in a front end portion of the lower ink chamber 51. Likewise, of course, the other components than the openings 145 and 149 are not limited to the arrangement positions described above, either.

Further, in the above embodiment, one inlet 112 is provided in each ink tank 100. However, two or more inlets 112 may be provided.

Further, in the above embodiment, one atmosphere opening port 187 is provided in each ink tank 100. However, two or more atmosphere opening ports 187 may be provided.

Further, in the above embodiment, one opening 158 is provided in each ink tank 100 for the ink to flow out of the ink chamber 111. However, two or more openings 158 may be provided.

Further, in the above embodiment, the second ink chamber 132 includes the buffer chamber 148 and the ink outflow passage 114. However, the first ink chamber 131 may include the buffer chamber 148 and the ink outflow passage 114. In this case, the buffer chamber 148 is interposed between the first ink chamber 131 and the ink outflow passage 114. Further, both the first ink chamber 131 and the second ink chamber 132 may include the buffer chamber 148 and the ink outflow passage 114.

Further, in the above embodiment, the explanation was made with the inks as an example of the liquid. However, the present teaching is not limited to this. That is, instead of the inks, examples of the liquid may be pretreatment liquid jetted to the recording paper before applying the inks in printing, water and like to spray in the vicinity of the recording head 39 and the nozzles 40 for preventing the recording head 39 and the nozzles 40 from drying, or the like.

What is claimed is:

1. A tank configured to be installed in a liquid consuming apparatus having a liquid consuming unit, the tank comprising:

a casing having a wall defining a storage chamber configured to store liquid, wherein the casing is formed with:

an inlet through which the liquid is supplied to the storage chamber;

an atmosphere opening port communicating the storage chamber and the outside of the tank; and a liquid outflow port through which the liquid stored in the storage chamber flows out toward the liquid consuming unit, the storage chamber includes a first storage chamber and a second storage chamber which are in communication with each other through a communication port formed in the wall, with the tank in a usable posture, at least a part of the first storage chamber is arranged above the second storage chamber, and the first storage chamber is always in communication with the outside of the tank through the atmosphere opening port without being blocked by the liquid stored in the liquid storage chamber, the second storage chamber includes a lower storage chamber and an upper storage chamber extending upward from the lower storage chamber, the wall forms an upper surface of the lower storage chamber, and the upper surface is inclined to rise toward the upper storage chamber from the position of the communication port.

2. The tank according to claim 1, wherein the communication port is formed in the lower storage chamber at one end side along an inclination direction of the upper surface, and the upper storage chamber is formed in the lower storage chamber at the other end side along the inclination direction of the upper surface.

* * * * *